US012366425B1

(12) United States Patent
Parker

(10) Patent No.: US 12,366,425 B1
(45) Date of Patent: Jul. 22, 2025

(54) MUZZLE-MOUNTED DEVICES

(71) Applicant: CGS Group, LLC, Artesia, NM (US)

(72) Inventor: Joshua J. Parker, Santa Rosa, CA (US)

(73) Assignee: CGS Group, LLC, Artesia, NM (US)

( * ) Notice: Subject to any disclaimer, the term of this patent is extended or adjusted under 35 U.S.C. 154(b) by 0 days.

(21) Appl. No.: 18/418,351

(22) Filed: Jan. 22, 2024

Related U.S. Application Data

(63) Continuation of application No. 17/347,471, filed on Jun. 14, 2021, now abandoned, which is a continuation-in-part of application No. PCT/US2019/066091, filed on Dec. 12, 2019.

(60) Provisional application No. 62/778,290, filed on Dec. 12, 2018.

(51) Int. Cl.
*F41A 21/30* (2006.01)

(52) U.S. Cl.
CPC ..... *F41A 21/30* (2013.01)

(58) Field of Classification Search
CPC ..... F41A 5/18; F41A 5/20; F41A 5/24; F41A 5/26; F41A 5/28; F41A 21/30–38
USPC ..... 89/14.2–14.4, 191.01–193; 181/223
See application file for complete search history.

(56) References Cited

U.S. PATENT DOCUMENTS 1,901,138 A * 3/1933 Barnes ..... F41A 21/30 89/14.3
2,777,366 A 1/1957 Cook
3,359,860 A * 12/1967 Muhlemann ..... F41A 5/26 89/193
3,988,964 A 11/1976 Moore
4,373,423 A 2/1983 Moore
5,831,202 A * 11/1998 Rustick ..... F41A 21/26 89/193
8,393,259 B2 3/2013 LaRue
8,528,458 B2 * 9/2013 Windauer ..... F41A 5/26 89/193
8,640,598 B1 2/2014 Jackson
11,287,200 B1 * 3/2022 Oglesby ..... F41A 21/325
2004/0237766 A1 12/2004 Cornils
2005/0115398 A1 * 6/2005 Olson ..... F41A 21/00 89/193
2014/0190345 A1 * 7/2014 Daniel ..... F41A 21/325 89/193
2015/0184960 A1 * 7/2015 Monveldt ..... F41A 5/26 89/193
2016/0003566 A1 1/2016 Gomirato et al.
(Continued)

*Primary Examiner* — Troy Chambers
*Assistant Examiner* — Benjamin S Gomberg
(74) *Attorney, Agent, or Firm* — Lightfoot & Alford PLLC

(57) ABSTRACT

An assembly directing gas to an action of a firearm has a barrel with a bore and a forward sealing surface. A gas block has a bore, a port for directing gases from the block bore through the block port, a rearward sealing surface for sealingly mating with the forward sealing surface of the barrel, and a forward sealing surface. A component has a bore and is attached to a forward end of the barrel, the component bore being in fluid communication with the barrel bore. At least one port communicates the component bore with the block port, the component having a rearward sealing surface for sealingly mating with the forward sealing surface of the gas block. A portion of the component rearward of the rearward sealing surface is received within the bore of the gas block. The barrel and component cooperate to sealingly retain the gas block therebetween.

20 Claims, 48 Drawing Sheets

(56) References Cited

U.S. PATENT DOCUMENTS

| | | | | |
|---|---|---|---|---|
| 2016/0216055 | A1 | 7/2016 | Wilkinson et al. | |
| 2018/0202744 | A1* | 7/2018 | De Sousa | F41A 21/30 |
| 2019/0170460 | A1* | 6/2019 | Kingsbury | F41A 5/26 |
| 2020/0025476 | A1* | 1/2020 | Aubin | F41A 5/26 |
| 2020/0263943 | A1* | 8/2020 | Kingsbury | F41A 21/325 |
| 2021/0207904 | A1 | 7/2021 | Kroyer et al. | |
| 2021/0381792 | A1* | 12/2021 | Young | F41A 21/30 |

* cited by examiner

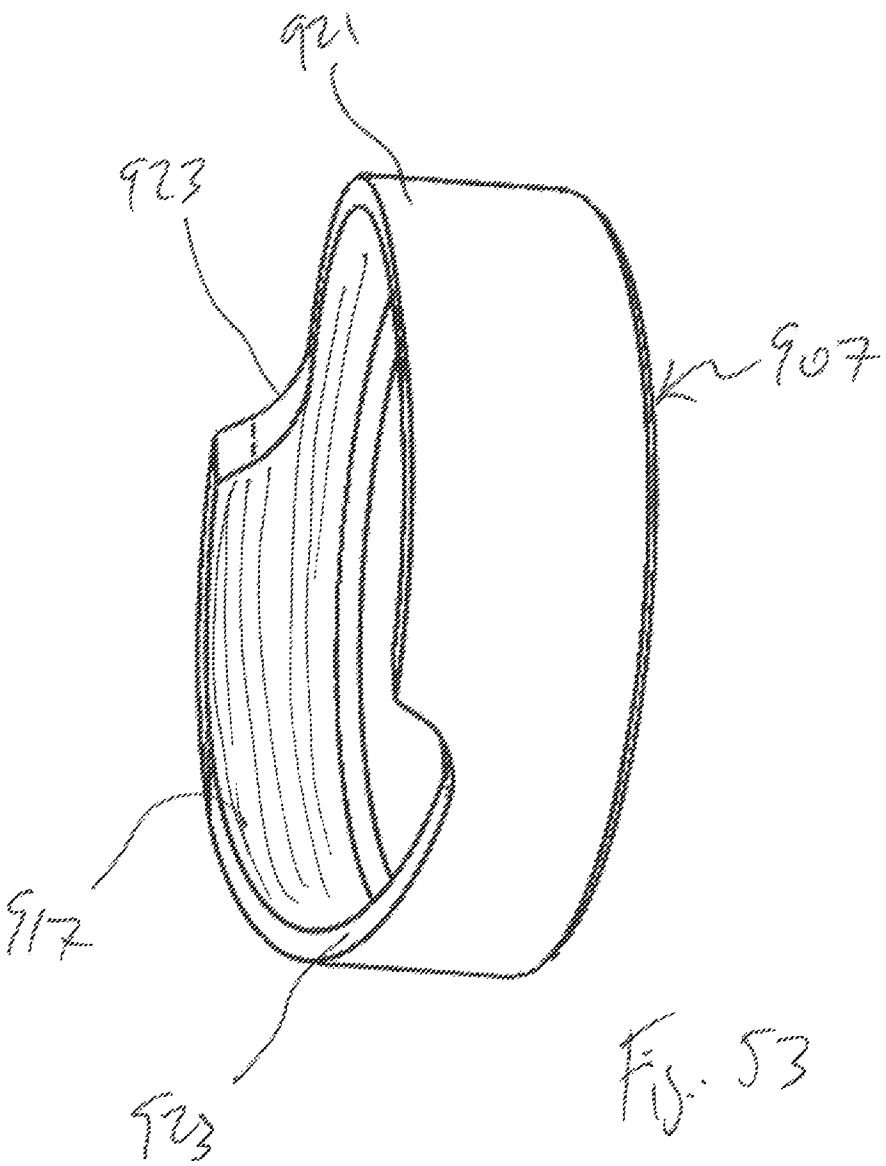
Fig. 53
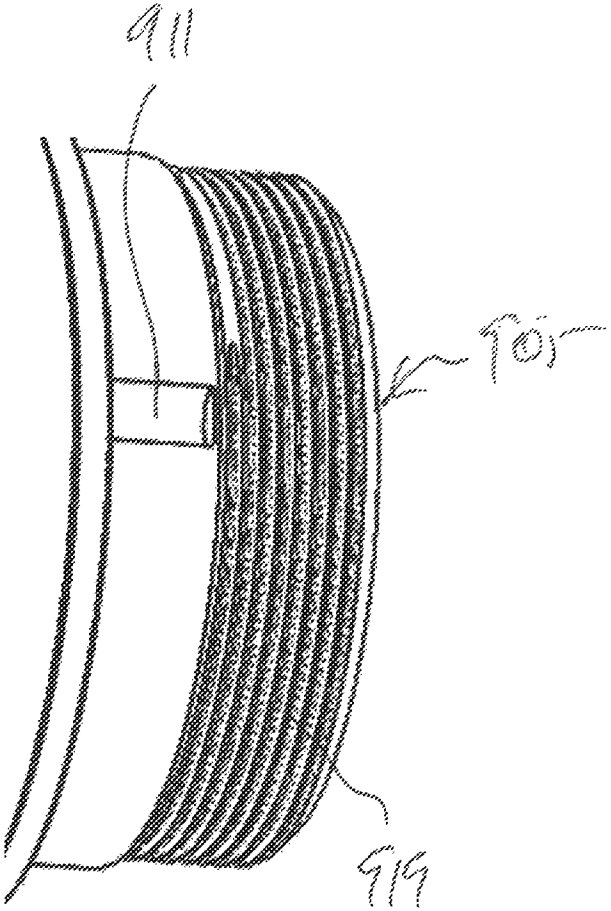

MUZZLE-MOUNTED DEVICES

CROSS-REFERENCE TO RELATED APPLICATIONS

This disclosure claims the benefit of the filing date of U.S. 62/778,290, filed on 12 Dec. 2018, and is a continuation of U.S. Ser. No. 17/347,471, filed on 14 Jun. 2021, which was a bypass continuation-in-part of PCT/US2019/066091, filed on 12 Dec. 2019, all titled MUZZLE-MOUNTED DEVICES, the entire content of each being incorporated by reference.

TECHNICAL FIELD

This disclosure relates to muzzle mounted devices.

BACKGROUND

Suppressors for firearms are designed to dissipate the energy of gases and particulates discharged from the muzzle to reduce the ambient noise created by the discharge. Typical suppressors have a plurality of baffles carried within a tube or other housing, and the baffles may be of various designs. Each baffle has a bore for allowing a projectile to pass through the baffle, and the baffles are arranged in a stack for aligning the bores.

BRIEF DESCRIPTION OF THE DRAWINGS

FIGS. 1 through 8 are views of an embodiment of a handgun compensator assembly, components thereof, and a method for installation thereof, all according to this disclosure.

FIGS. 9 through 14 are views of embodiments of a muzzle brake assembly and components thereof, all according to this disclosure.

FIGS. 23 and 24 are views of an embodiment of a piston assembly and components thereof, all according to this disclosure.

FIGS. 26 through 29 are views of embodiments of a suppressor front cap according to this disclosure.

FIGS. 38 through 42 are views of an embodiment of a suppressor according to this disclosure.

FIGS. 47 through 55 are views of embodiments of suppressor assemblies and components thereof according to this disclosure.

DETAILED DESCRIPTION

Figures 1, 2:
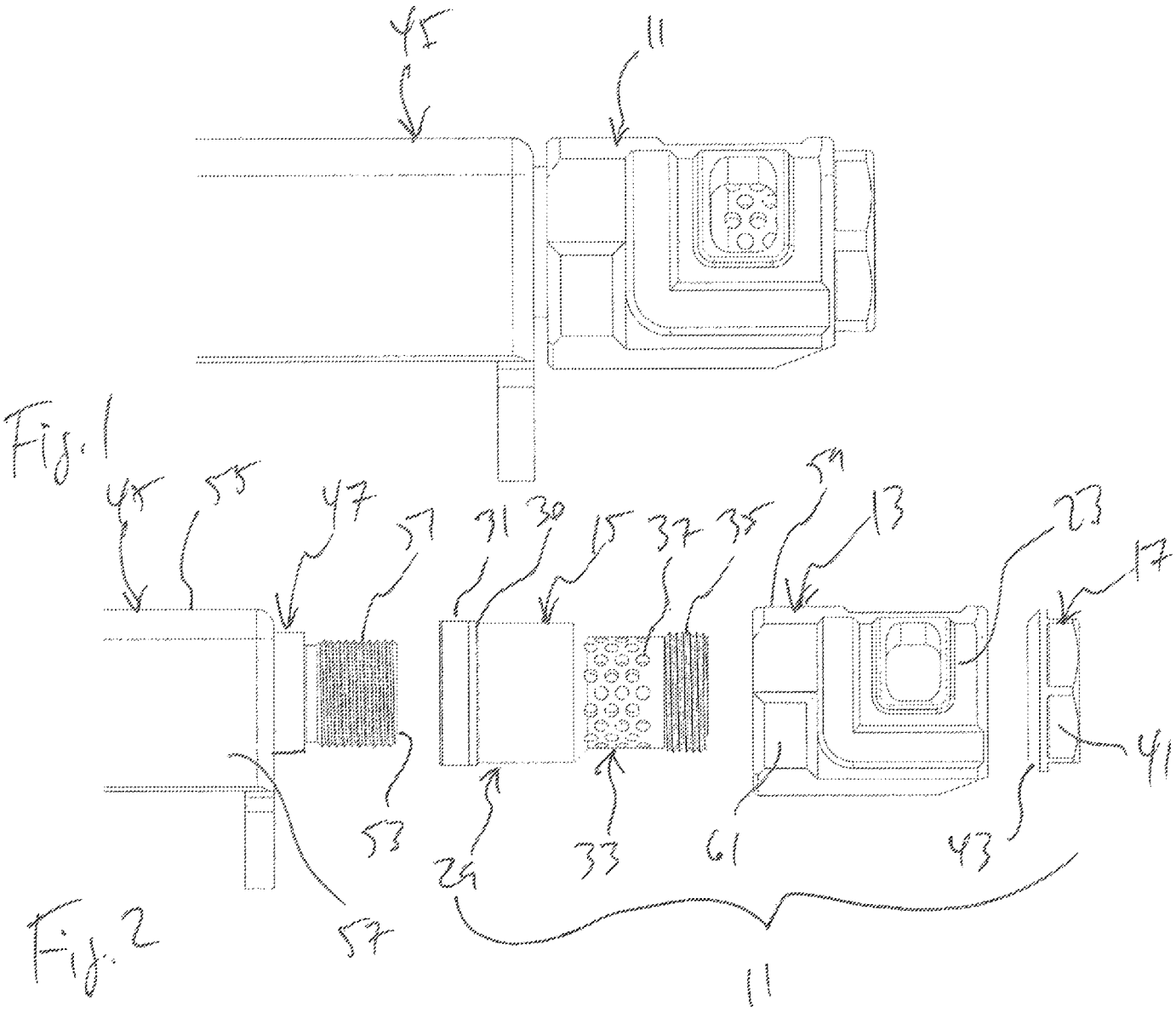
Figure 4:
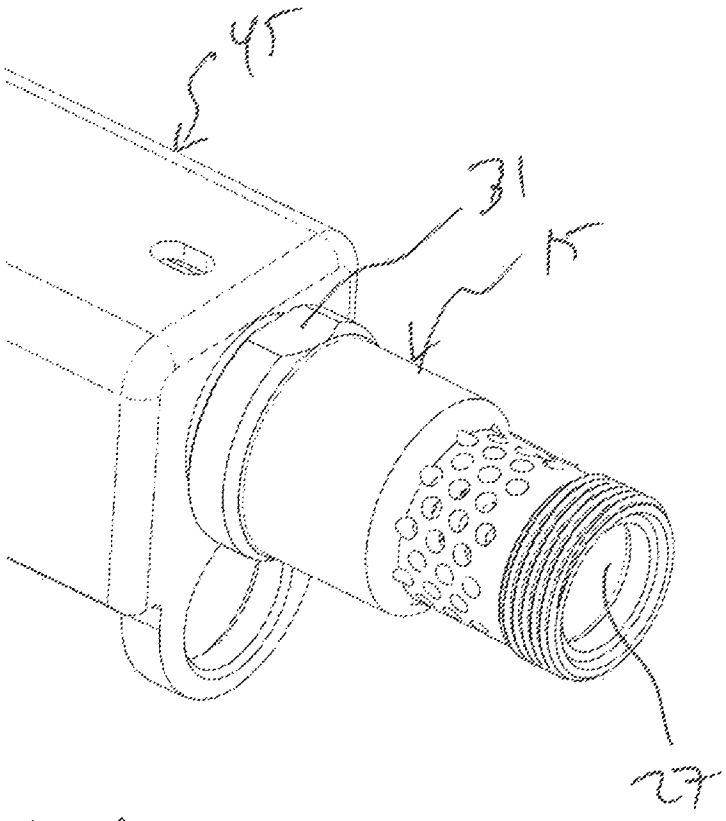
Figure 5:
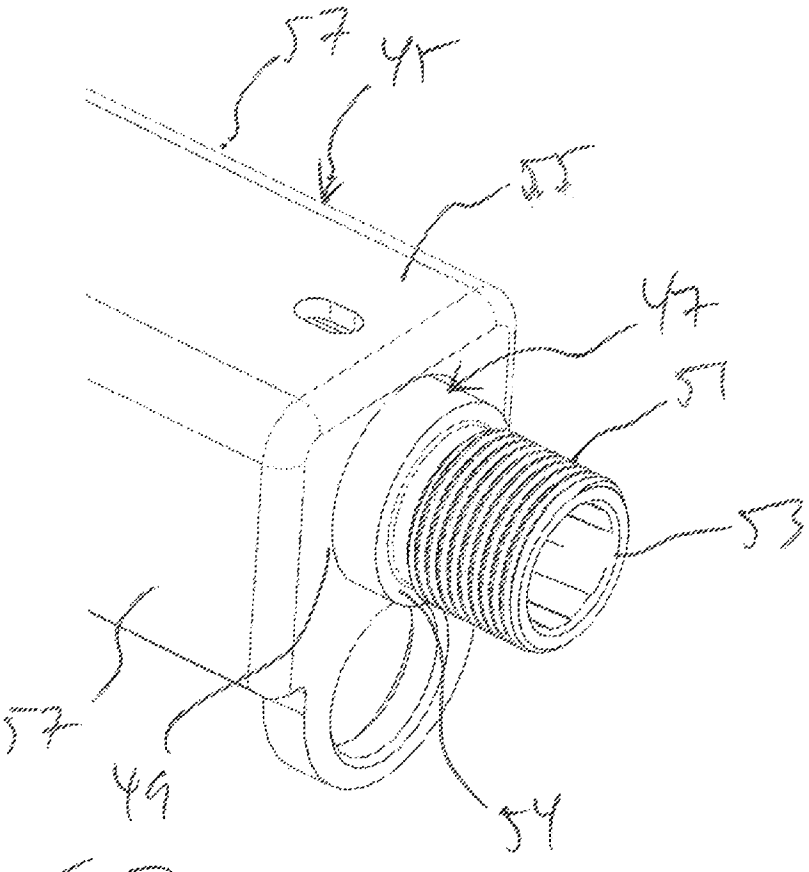

In the specification, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure divulges new concepts for muzzle-mounted devices for firearms.

FIGS. 1 through 8 are views of an embodiment of a handgun compensator/brake assembly according to this disclosure, components thereof, and a method for installation thereof.

Compensator assembly 11 comprises a cage 13, brake 15, and nut 17. Cage 13 is generally rectangular and hollow, with a rear tapered aperture (not visible) and a forward aperture 19, upper aperture 21, and side apertures 23. Forward aperture 19 has a tapered inner surface 25. Brake 15 is generally cylindrical, with a bore 27 therethrough. Bore 27 is not rifled and is larger than the caliber of the handgun, allowing projectiles to pass through without contacting bore 27. A rear mounting portion 29 has internal threads, an external tapered surface 30 configured to engage the rear tapered surface of cage 13, and wrench flats 31. A forward brake portion 33 has external threads 35 and radial apertures 37 arrayed around portion 33 and extending therethrough to bore 27. Nut 17 has internal threads 39, wrench flats 41, and a tapered rear surface 43 configured for engaging surface 25 of cage 13.

In the embodiments shown, compensator assembly 11 is configured for use with a handgun for mounting adjacent the muzzle of the barrel of the handgun. In the figures, handgun slide 45 houses barrel 47, which protrudes through aperture 49 of slide 45. Barrel 47 comprises forward external threads 51 adjacent muzzle 53 and a shoulder 54 rearward of threads 51.

Figure 6:
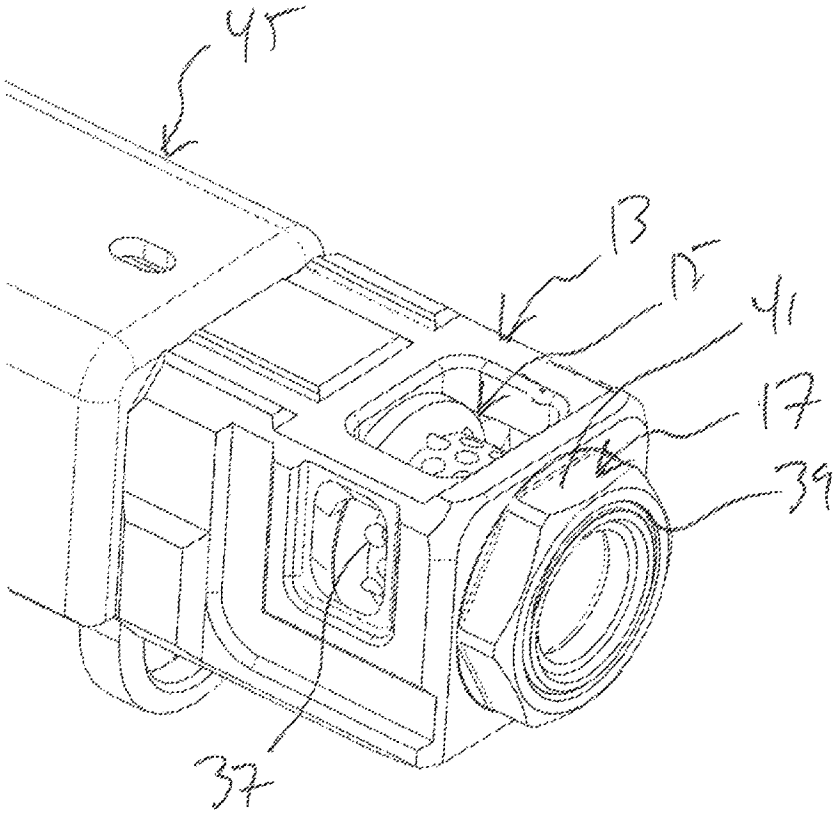
Figure 5:
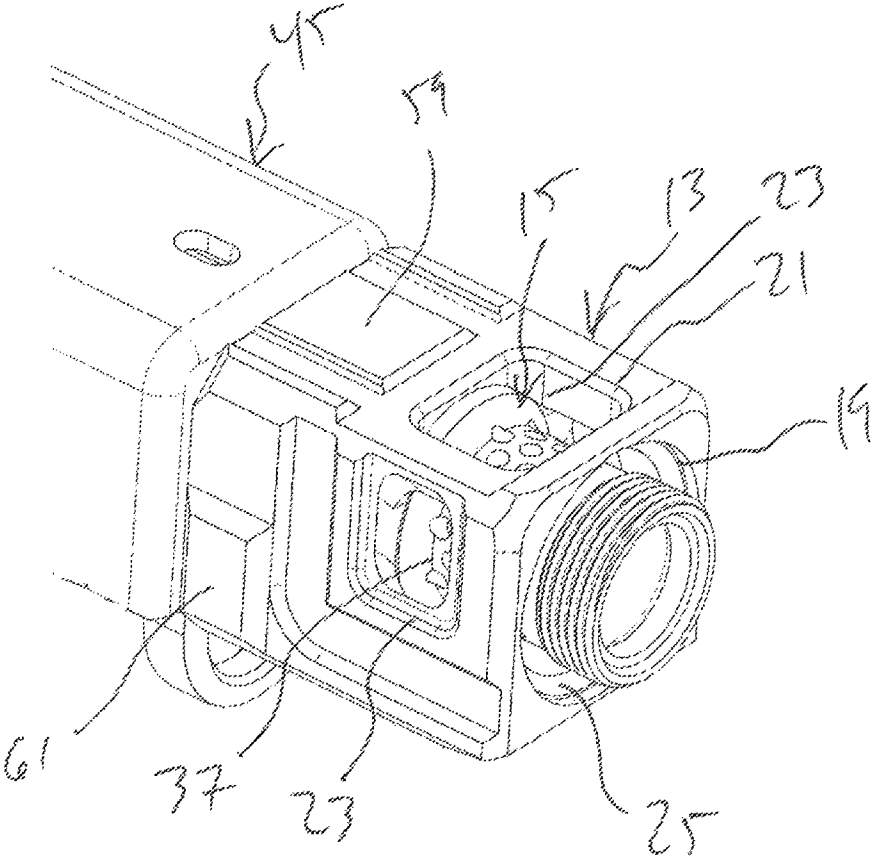

To install compensator assembly 11 on barrel 47, brake 15 is threaded onto threads 51 of barrel 47 until the rear of brake 15 contacts shoulder 54 (FIG. 4), cage 13 is placed over brake 15 so that the taper at the rear of cage 13 engages tapered surface 30 of brake 15 (FIG. 5), and nut 17 is threaded onto threads 35 of brake 15 so that tapered surface 43 engages tapered surface 25 of cage 13 (FIG. 6). Cage 13 is thereby captured between tapered surfaces 30 and 43, allowing for nut 17 to retain cage 13 on brake 15.

During use, gases and entrained particulates ("gases") expelled from muzzle 53 pass into and through bore 27 and through radial apertures 37 of brake 15, acting as a muzzle brake for reducing felt recoil when firing the handgun. Because of the radial arrangement of apertures 37, brake 15 is not required to be oriented relative to barrel 47. Gases expelled through apertures 37 enter the interior of cage 13 and exit through upper aperture 21 and side apertures 23, which are preferably oriented as shown in the figures. Cage 13 acts as an additional muzzle brake and as a muzzle compensator, reducing muzzle rise during recoil. This orientation ensures that gases expelled from apertures 37 on the lower portion of brake 15 are redirected toward one or more of apertures 21, 23 of cage 13. In the preferred embodiment, at least one of apertures 21, 23 is longitudinally aligned with one or more apertures 37 of brake 15.

Figure 7:
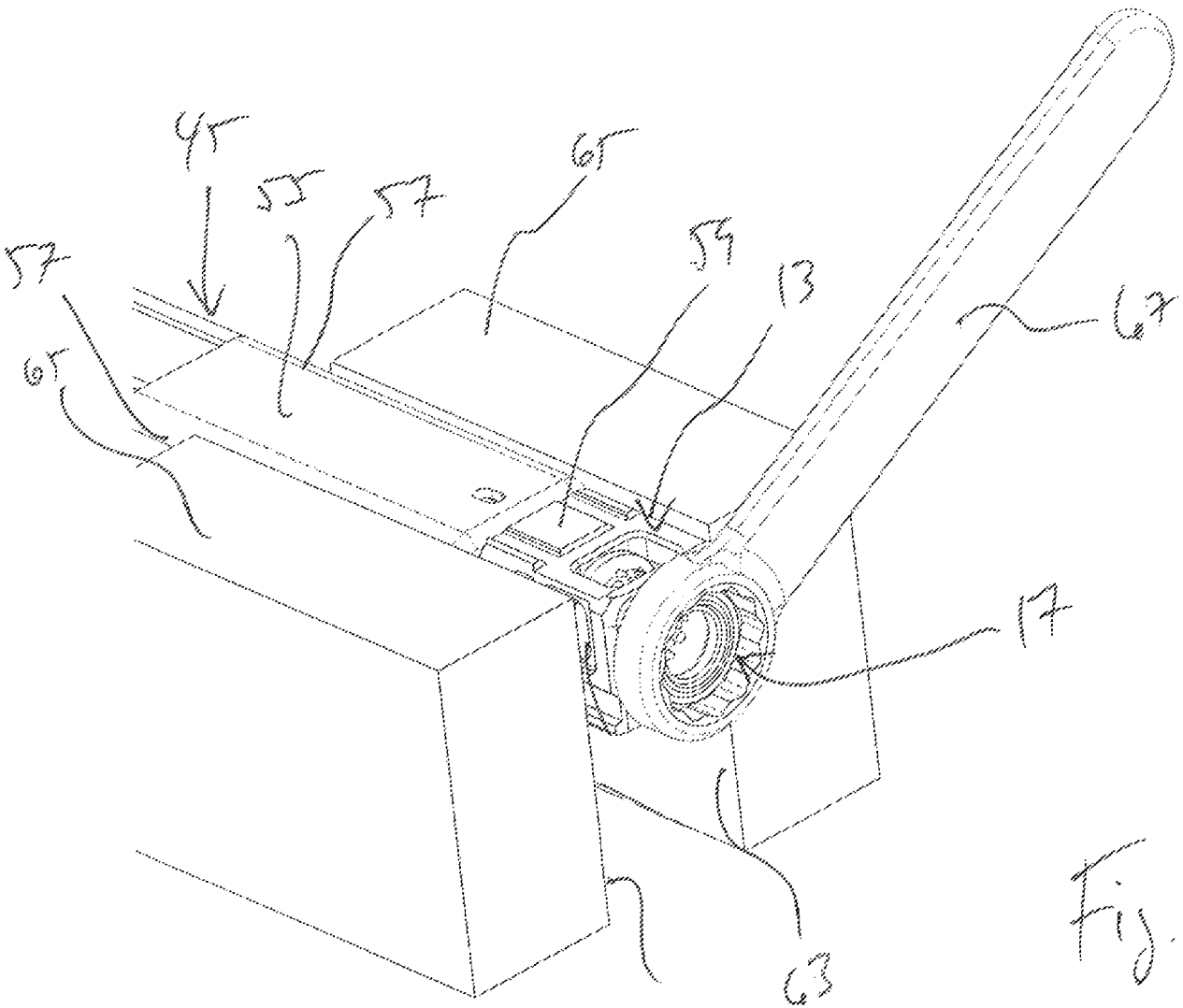
Figure 8:
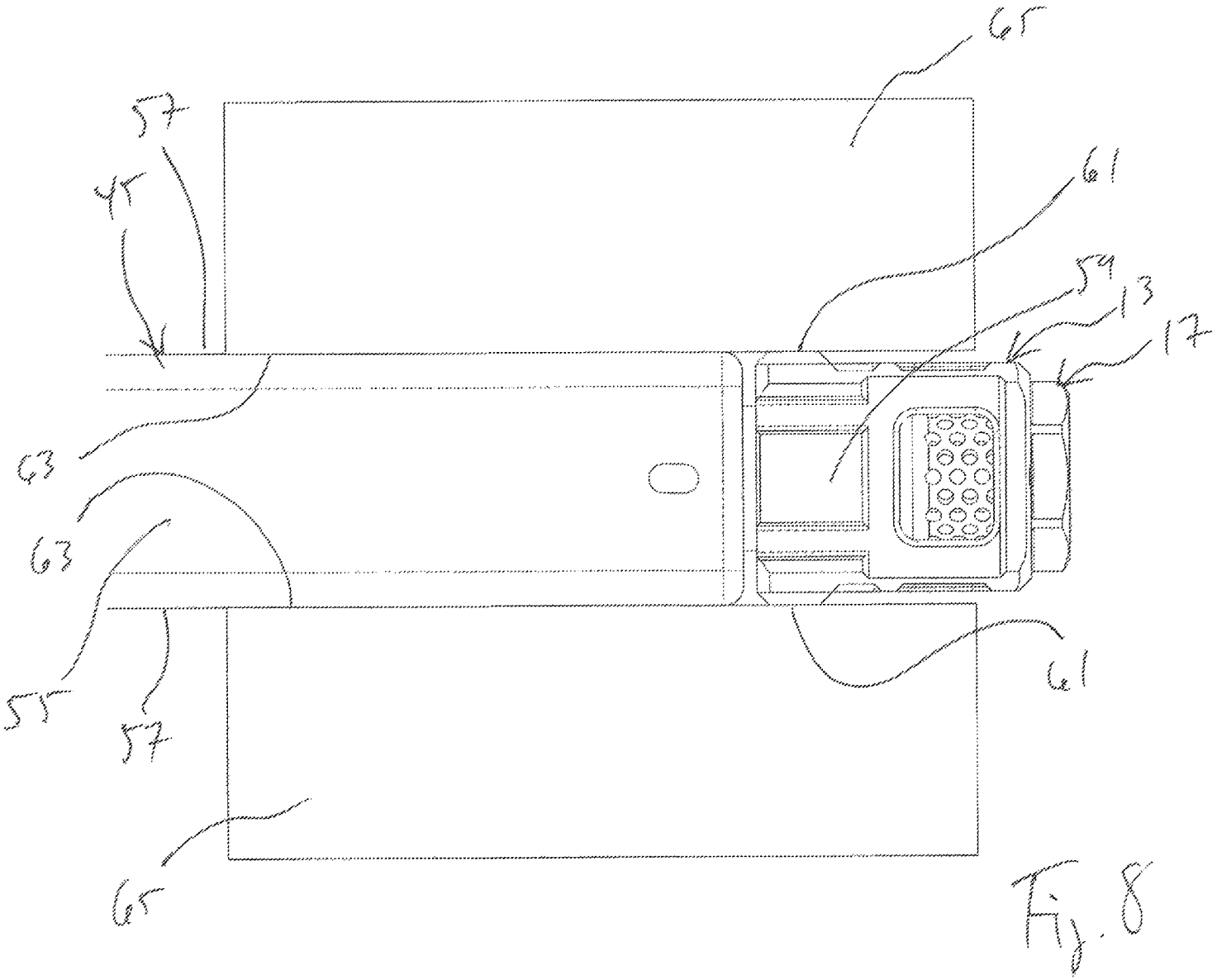
Figure 4:
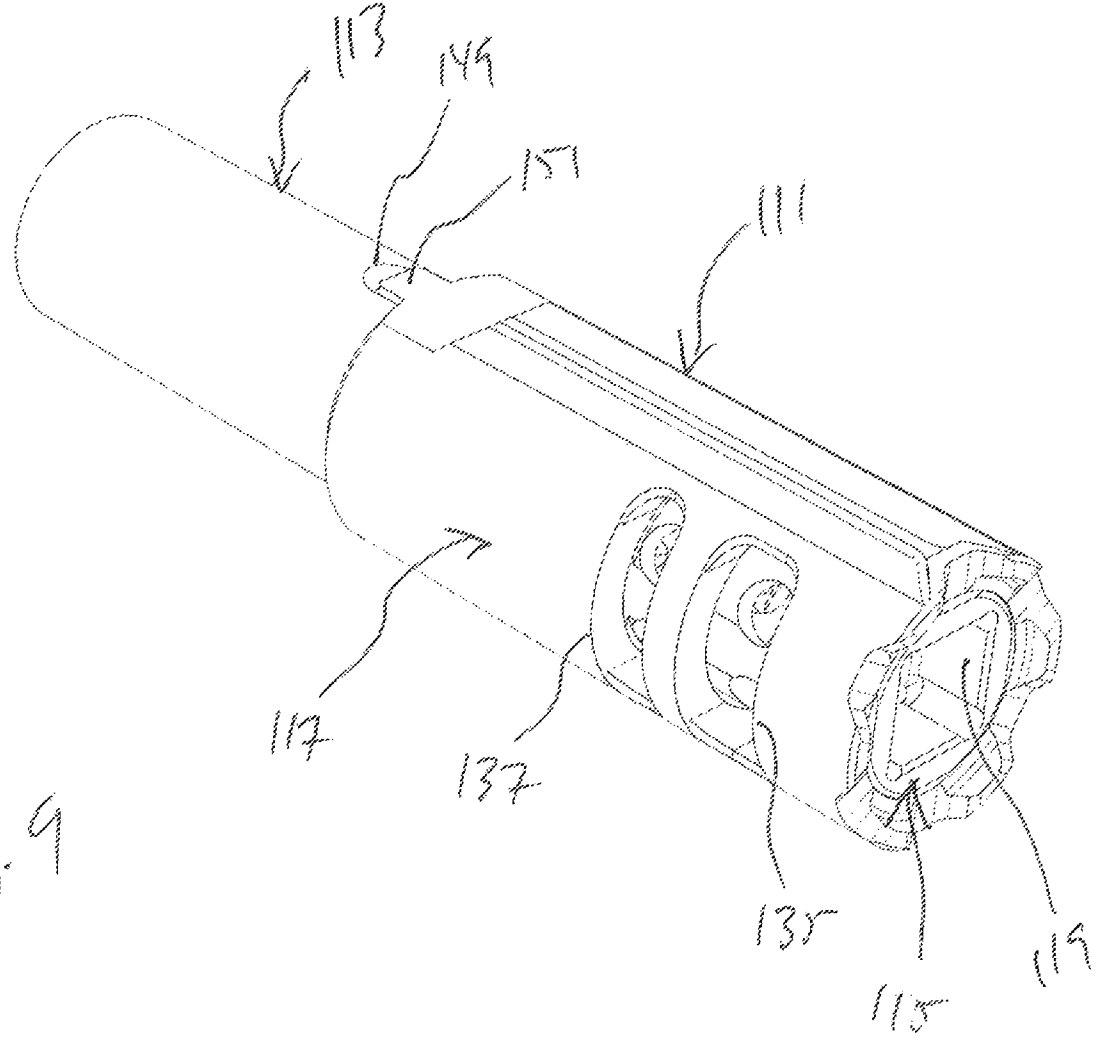
Figures 10, 11:
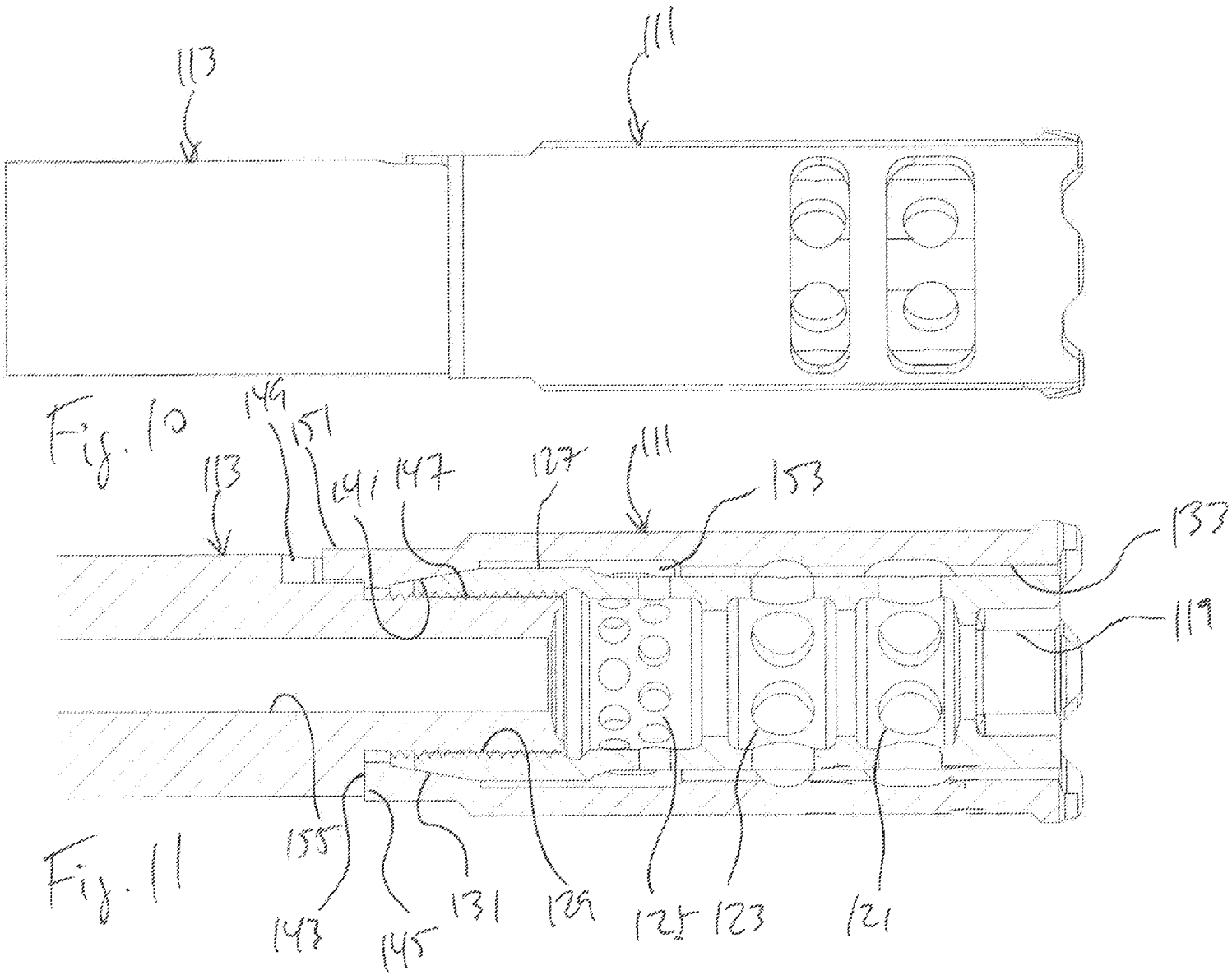
Figure 12:
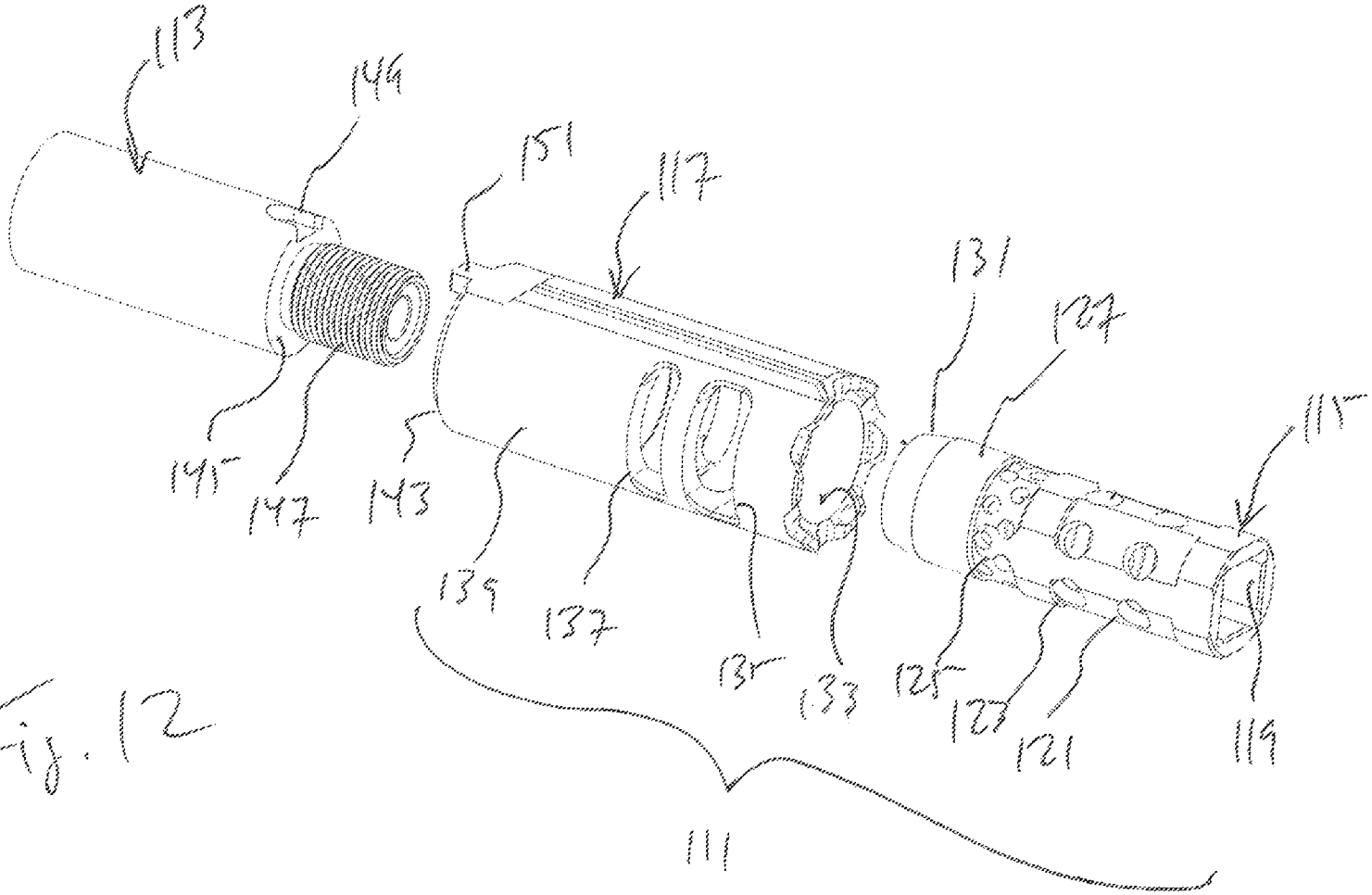

During installation, cage 13 is preferably oriented relative to barrel 47 for functional effects and oriented relative to slide 45 for aesthetics. As nut 17 is tightened to retain cage 13 on brake 15, the desired orientation may be maintained with the use of a cooperating notch and pin arrangement, with one component on each of cage 13 and brake 15, or similar features, such as, for example, detents, teeth, etc. However, to allow for fitment on a barrel lacking an alignment feature, FIGS. 7 and 8 illustrate a preferred method of aligning cage 13 with slide 45 while nut 17 is tightened to retain cage 13 on brake 15 and maintain the desired alignment. While brake 15 is shown as mating with shoulder 54 located rearward of threads 51, brake 15 may alternatively mate with a shoulder of muzzle 51.

Slide 45 is shown having a flat top surface 55 and parallel side surfaces 57, and the embodiment of cage 13 shown has a top flat 59 and side flats 61. When cage 13 is installed on barrel 47, top flat 59 is positioned the same distance from the centerline of muzzle 53 as top surface 55 of slide 45. Likewise, side flats 61 will be centered about muzzle 53 and spaced from each other the same distance as side surfaces 57 of slide 45. Parallel surfaces, such as surfaces 63 of vise jaws 65, can be used to simultaneously contact side flats 61 and side surfaces 57, aligning cage 13 in a parallel orientation relative to slide 45. While surfaces 63 maintain this alignment, a wrench 67 can be used to tighten nut 17.

FIGS. 9 through 14 are views of embodiments according to this disclosure of a muzzle brake assembly and components thereof.

FIGS. 9 through 12 illustrate an embodiment of a muzzle brake assembly 111 installed on a barrel 113. Brake assembly 111 comprises an inner brake 115 and an outer brake 117. Inner brake 115 is generally cylindrical and has a bore 119 extending longitudinally therethrough. Sets of front ports 121, intermediate ports 123, and rear ports 125 are arrayed around the side wall of inner brake 115, each port 121, 123, 125 extending radially to bore 119. A rear portion 127 has internal threads 129 and an external tapered surface 131. While bore 119 is shown as having a varying diameter, bore 119 may alternatively have a constant diameter.

Outer brake 117 is generally cylindrical and has a bore 133 extending longitudinally therethrough. Opposing front side ports 135 and opposing intermediate side ports 137 are located in the side wall of outer brake 117, each port 135, 137 extending radially to bore 133. A rear portion 139 has an internal tapered surface 141 and terminates in a mating surface 143. Though shown in this embodiment as a ported muzzle, outer brake 117 may alternatively be configured as a flash hider. While bore 133 is shown as having a varying diameter, bore 133 may alternatively have a constant diameter.

To install brake assembly 111, outer brake 117 is placed over the end of barrel 113, with mating surface 143 generally adjacent a shoulder 145 formed in an end portion of barrel 113. Inner brake 115 is inserted into bore 133 of outer brake 117 and rotated to engage threads 129 of inner brake 115 with external threads 147 on barrel 113. As inner brake 115 moves rearward on threads 147, tapered surface 131 mates with tapered surface 141, causing outer brake 117 to move rearward. This causes mating surface 143 to contact shoulder 145, allowing inner brake 115 to be tightened due to friction between tapered surfaces 131, 141. In order to align outer brake 117 so that ports 135, 137 point sideways, an optional notch 149 may be formed in barrel 113 for receiving an optional pin 151, or other protrusion, formed at the rear of outer brake 117, allowing inner brake 115 to be rotated without rotating outer brake 117. Bore 133 is larger than the outer diameter of inner brake 115, forming a circumferential gap 153 therebetween. In the embodiment shown, ports 121, 123 are longitudinally aligned with ports 135, 137 when brake assembly 111 is installed. As shown, the forward portion of bore 119 may have features allowing a tool to engage inner brake 115 for rotating inner brake 115.

During operation, gases are expelled from a bore 155 of barrel 113 into bore 119 of inner brake 115. Gases are allowed to exit the front of bore 119, but fluid pressure causes gases to also exit bore 119 through ports 121, 123, 125. While the gases from ports 121, 123 are generally directed at ports 135, 137, gases exiting bore 119 through ports 125 travel forward in gap 153 to exit through ports 135, 137 or through the front of gap 153.

Figure 13:
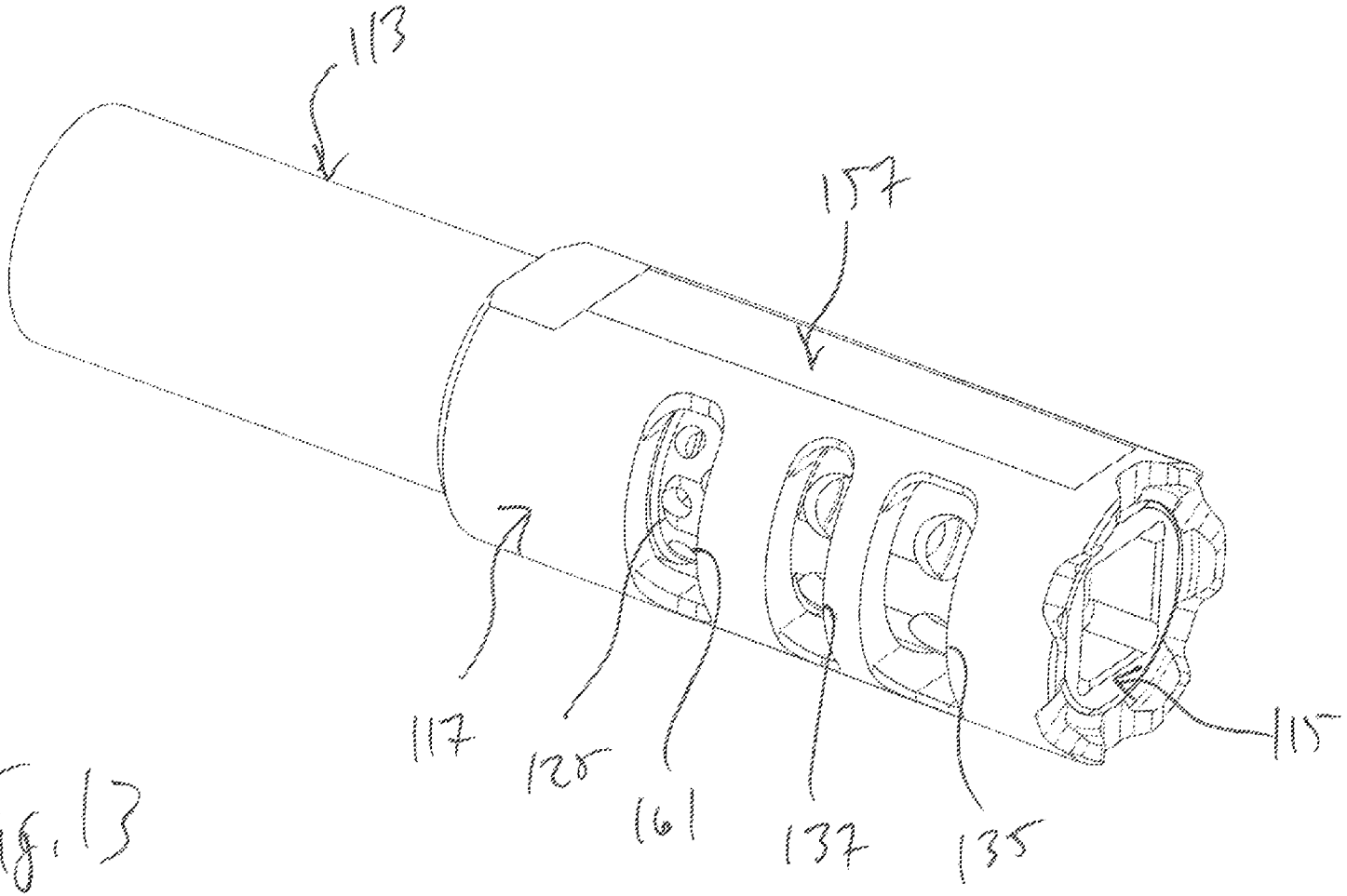
Figure 14:
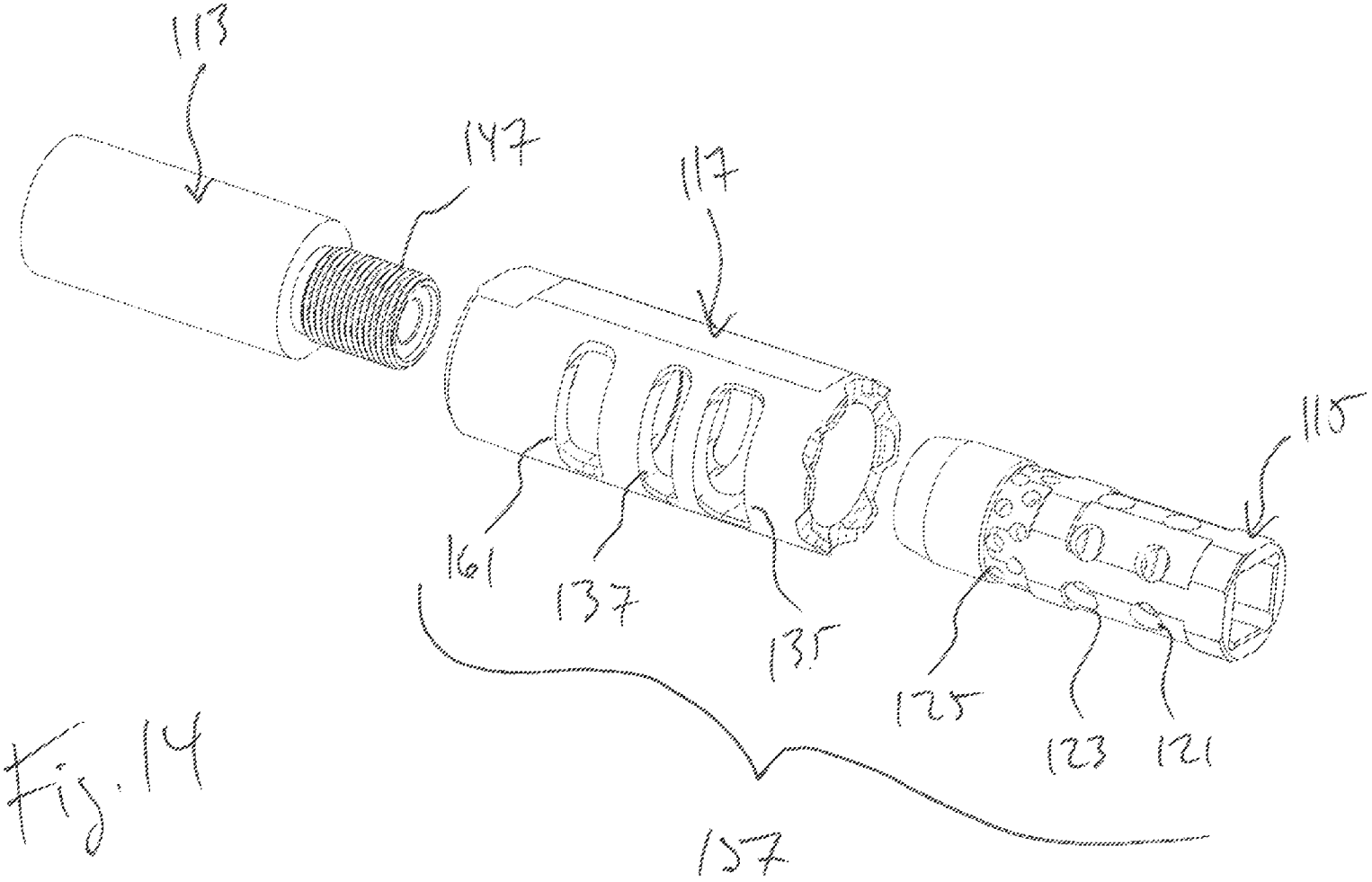
Figure 16:
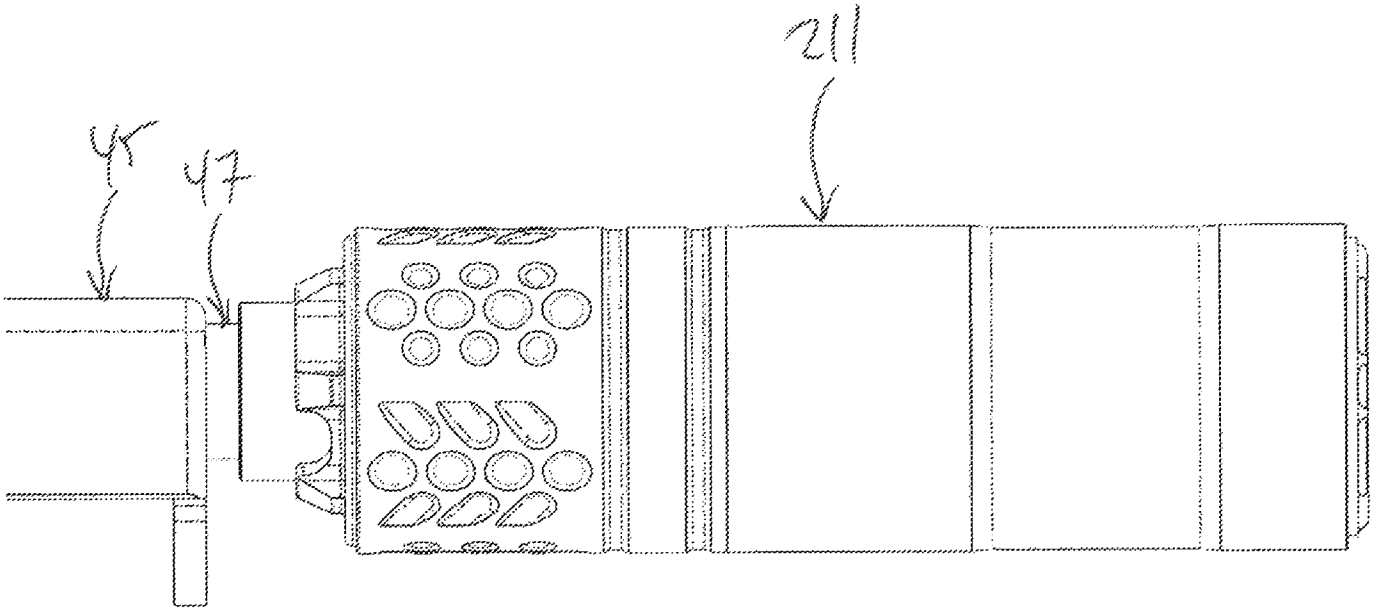
FIGS. 15 through 22 are views of embodiments of a suppressor assembly and components thereof, all according to this disclosure.
Figure 16:
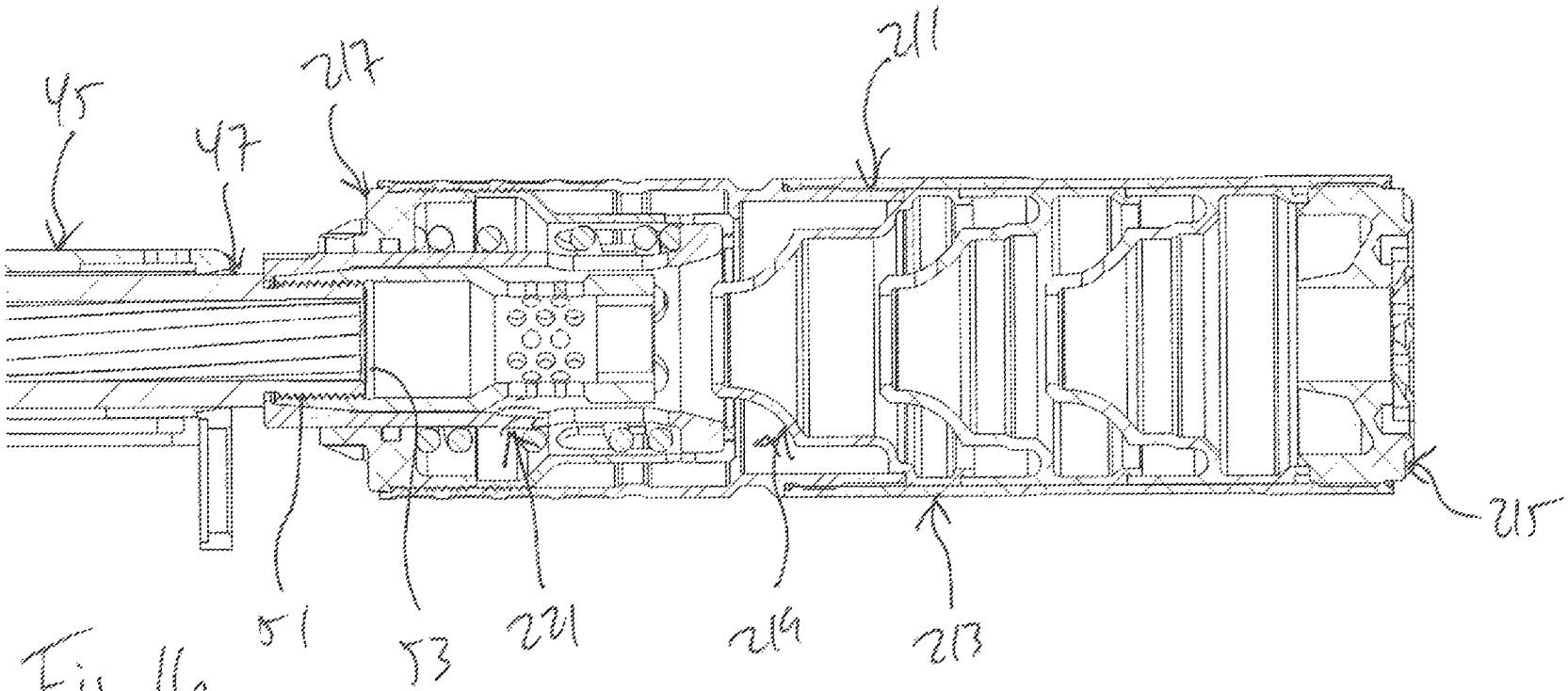
Figure 17:
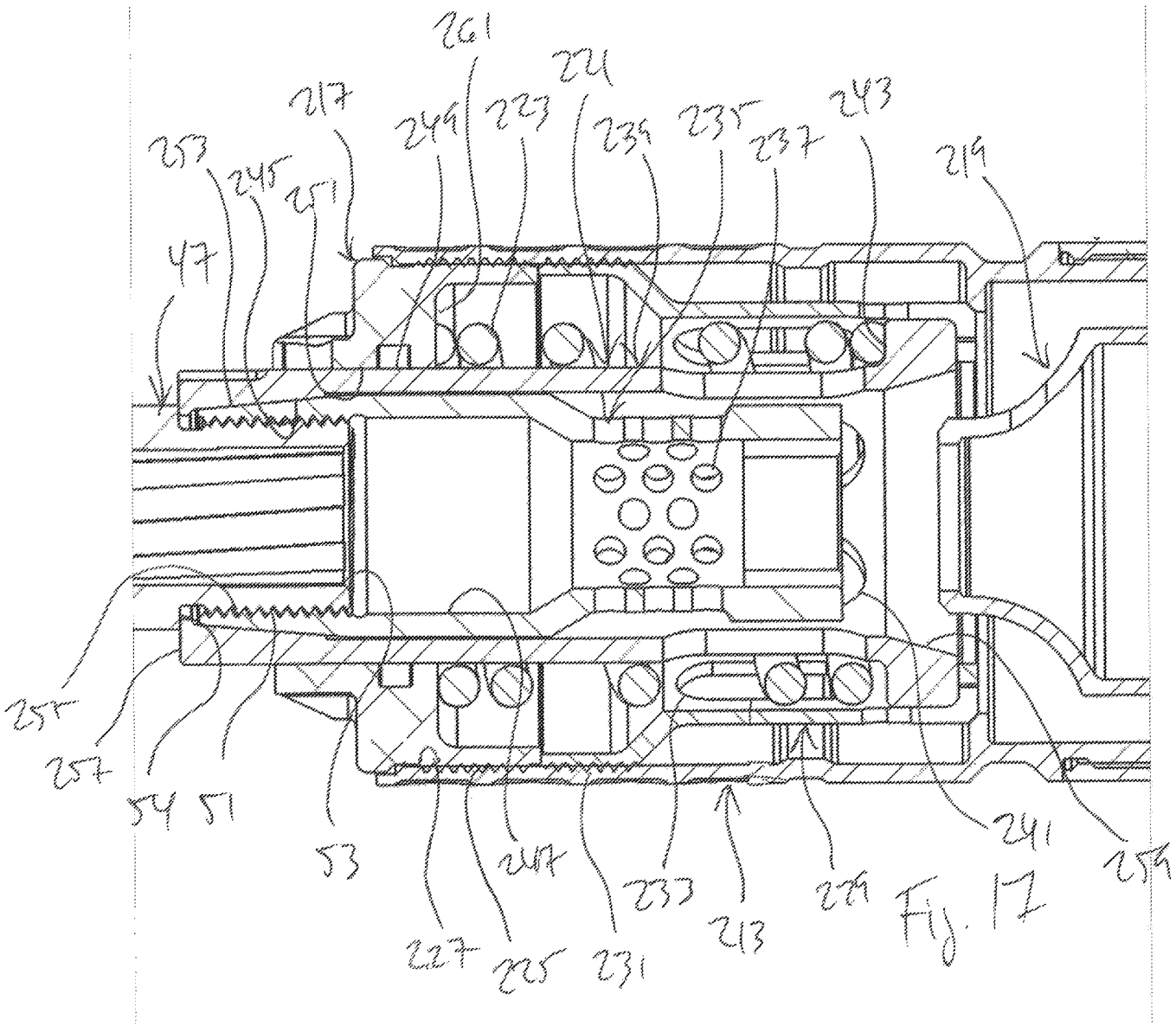
Figure 18:
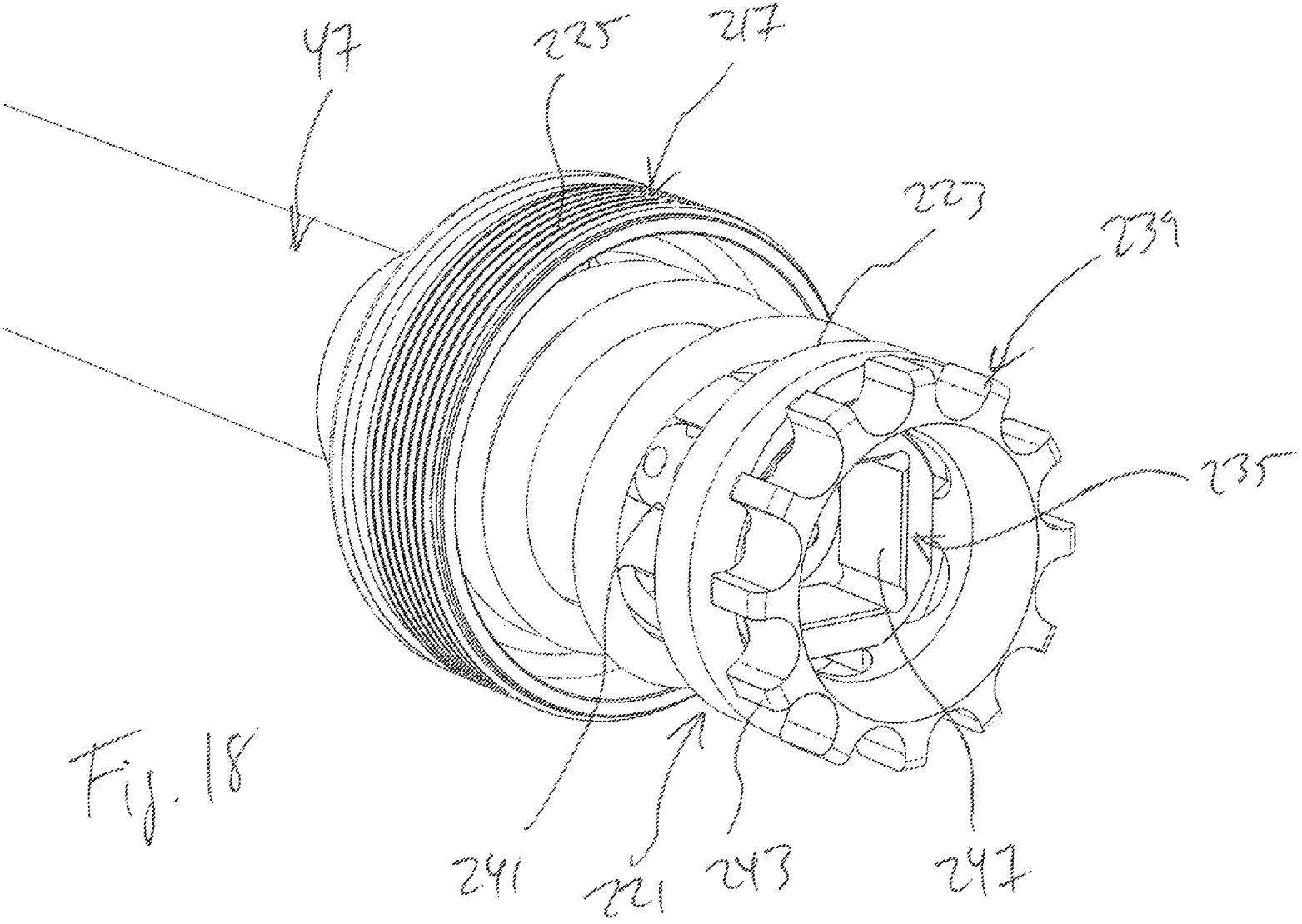
Figure 15:
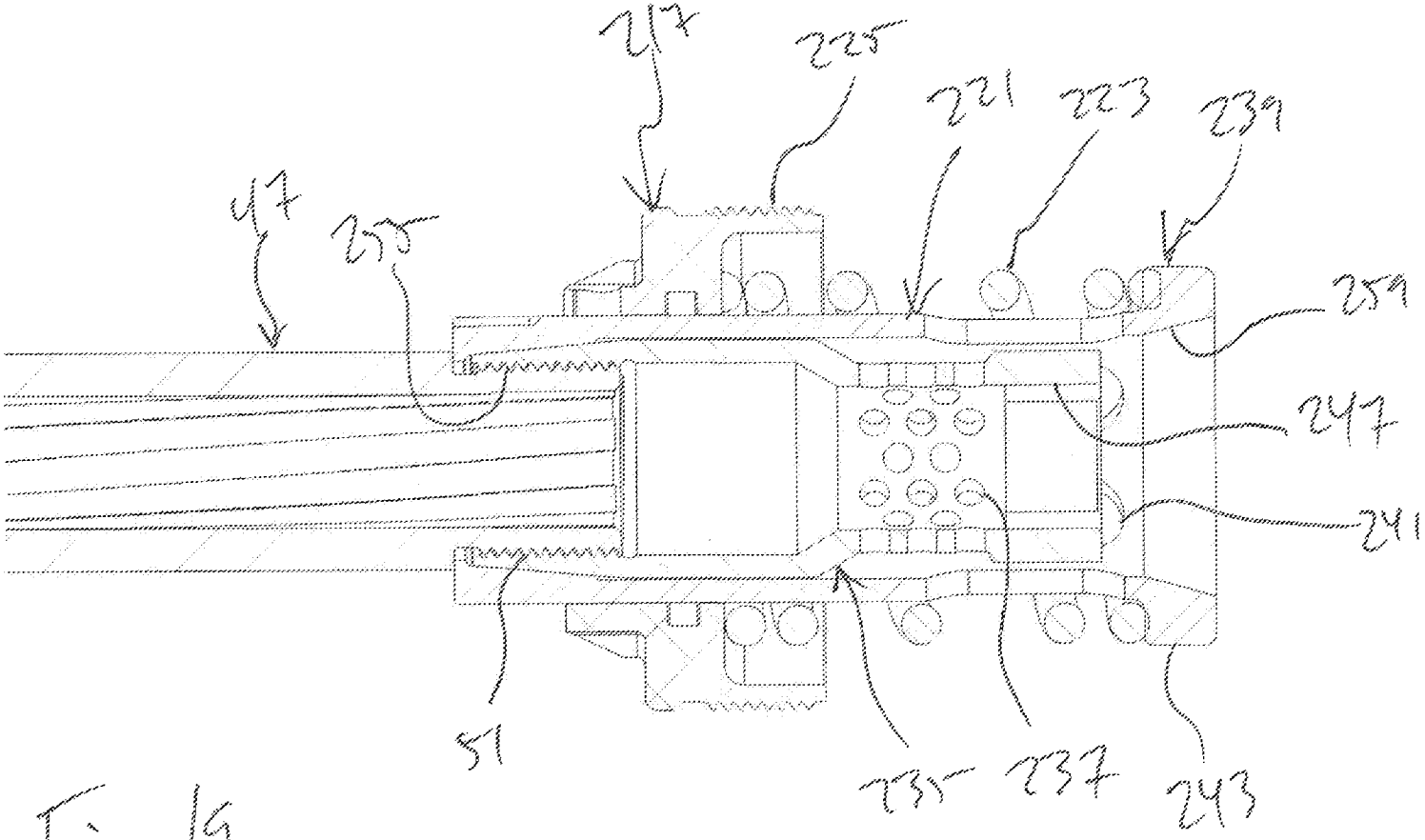
Figure 20:
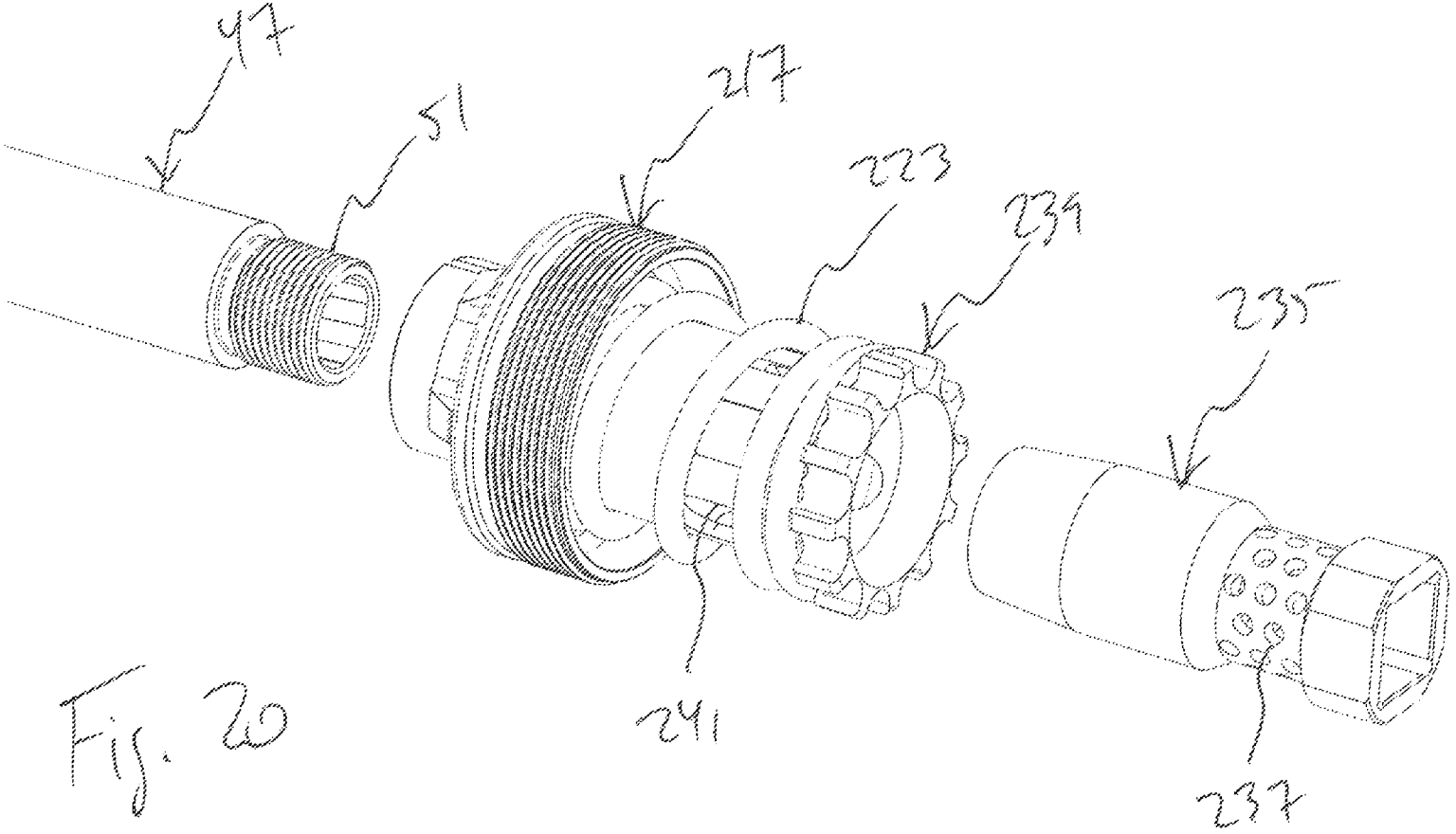

FIGS. 13 and 14 illustrate another embodiment of a muzzle brake assembly 157 according to this disclosure and installed on barrel 113, which lacks optional notch 149. Brake assembly 111 comprises inner brake 115 and an outer brake 159. Outer brake 159 differs from outer brake 117 by lacking optional pin 151 and by incorporating a third set of opposing side ports 161. Ports 161 are generally longitudinally aligned with ports 125 of inner brake 115 when brake 115 is tightened on threads 147 of barrel 113.

FIGS. 15 through 25 are views of embodiments of a suppressor assembly according to this disclosure and components thereof.

Suppressor assembly 211 is shown assembled on barrel 47 adjacent slide 45, and assembly 211 comprises tube 213, front cap 215, rear cap 217, baffle stack 219, and piston assembly 221. In the embodiment shown, tube 213 is formed from multiple components. Piston assembly 221 allows tube 213, caps 215, 217, and baffle stack 219 to translate together longitudinally relative to piston assembly 221 while being biased rearward by spring 223. Rear cap 217 has external threads 225 for engaging internal threads 227 of a rear portion of tube 213. A piston housing 229 also has external threads 231 for engaging threads 227 of tube 213, housing 229 having ports 233 in a sidewall.

Piston assembly 221 comprises a core 235 having ports 237 and a piston 239. Piston 239 has ports 241, an interrupted spring shoulder 243 on a forward portion, a tapered inner surface 245 on a rear portion, a bore 247, and an outer surface 249 configured to allow an inner surface 251 of rear cap 217 to sealingly slide along surface 249. Core 235 has a tapered outer surface 253 configured to mate with tapered surface 245 of piston 239, internal threads 255 for engaging threads 51 of barrel 47, a rear surface 257 for mating with shoulder 54, and a bore 259. When assembled, spring 223 is captured between shoulder 243 and an inner surface 261 of rear cap 217. Because housing 229 and rear cap 217 are coupled to tube 213, these components can translate longitudinally together relative to piston assembly 221. The inner surface of housing 229 contacts shoulder 243 to limit the rearward travel of the coupled components. Baffle stack 219 is retained within tube 213 by front cap 215, and these translate together with tube 213 and rear cap 217. During operation, gases may flow through ports 233, 237, 241 into the interstitial spaces and chambers formed by the gaps between core 235, piston 239, housing 229, baffle stack 219, and tube 213.

Figure 21:
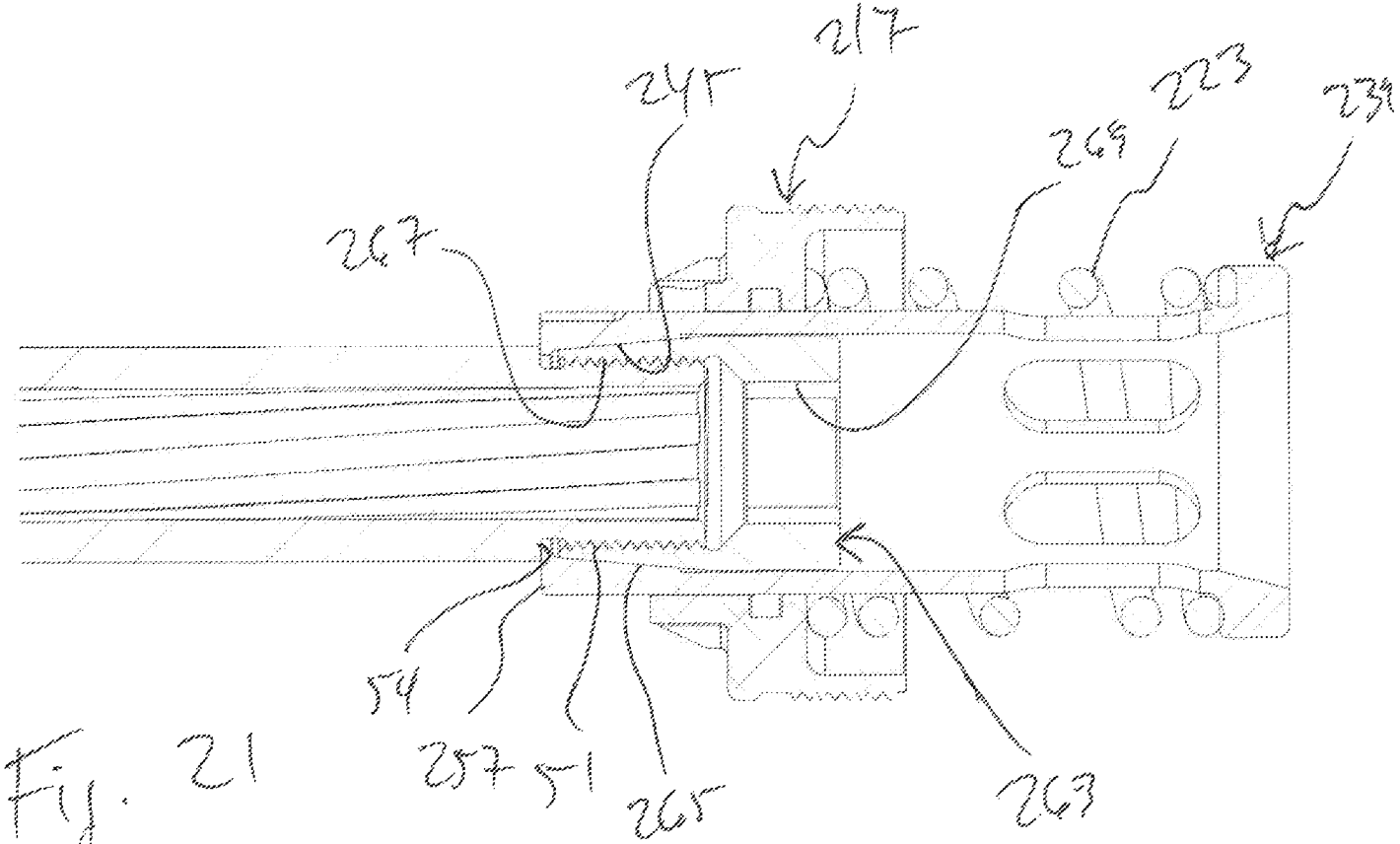
Figure 22:
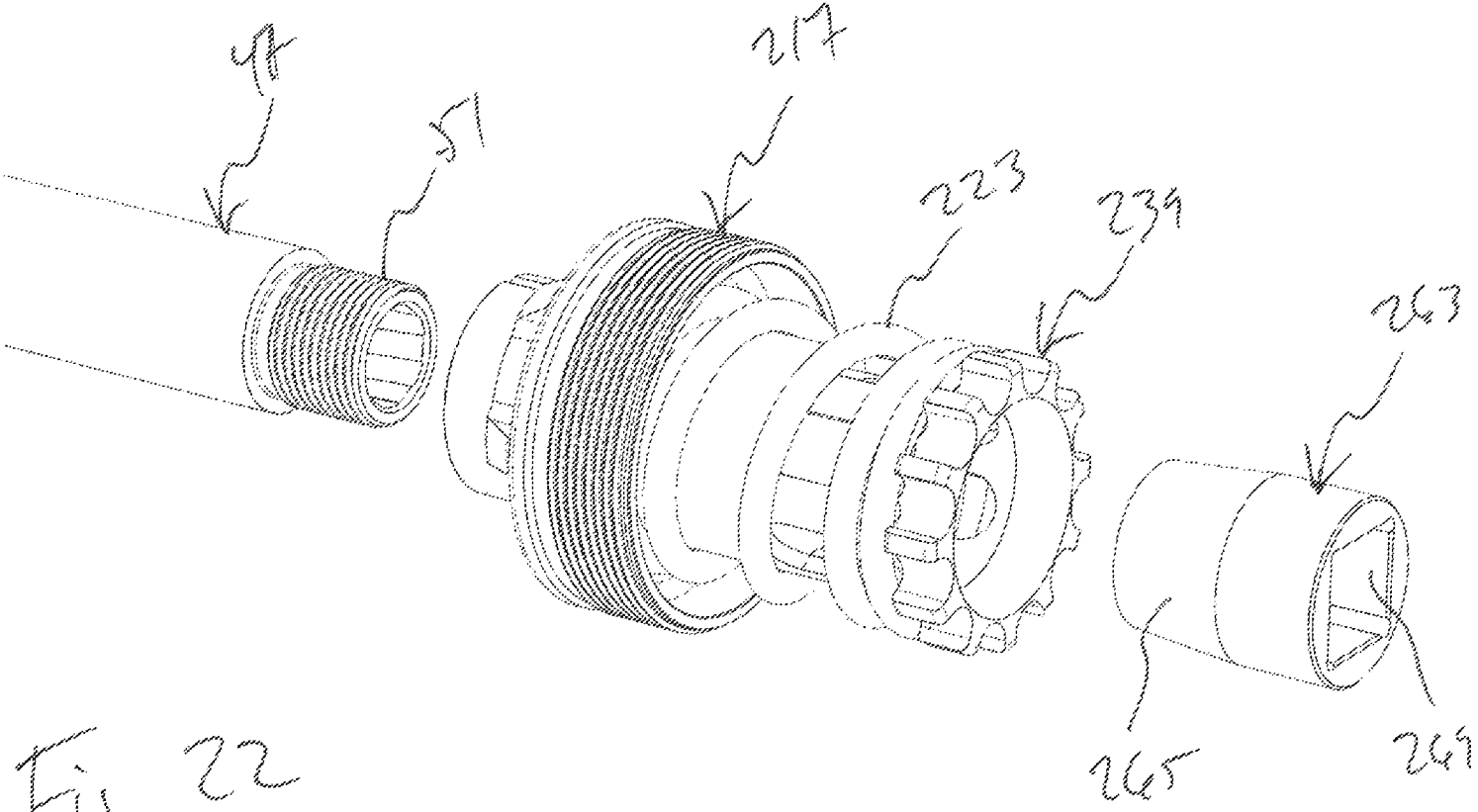
Figure 18:
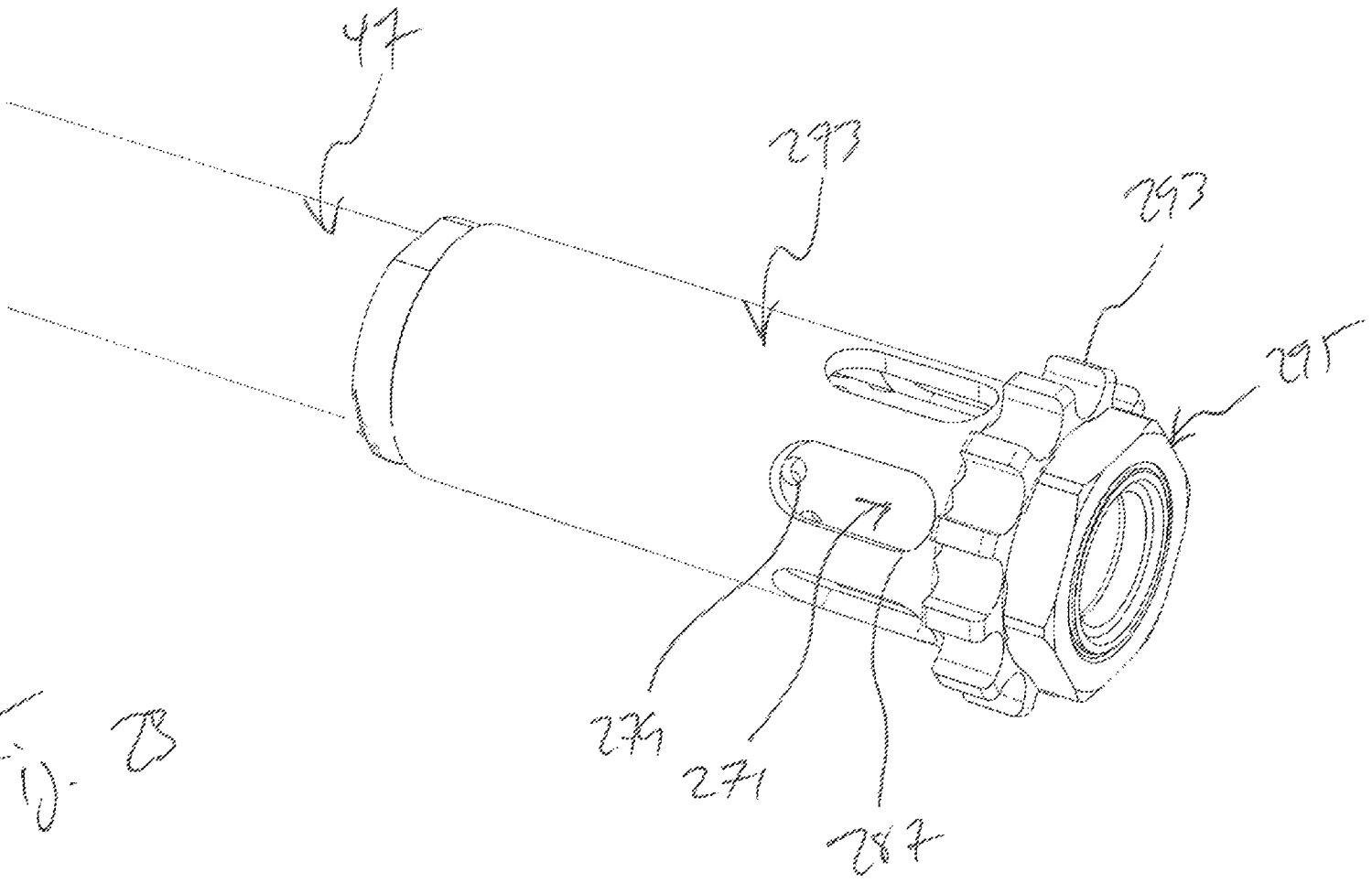

FIGS. 21 and 22 illustrate another embodiment of a piston assembly according to this disclosure. In this embodiment, piston 239 is coupled to barrel 47 by core 263, which has an external tapered surface 265 configured for mating with tapered surface 245 of piston 239, internal threads 267 for engaging threads 51 of barrel 47, and a bore 269.

Figure 24:
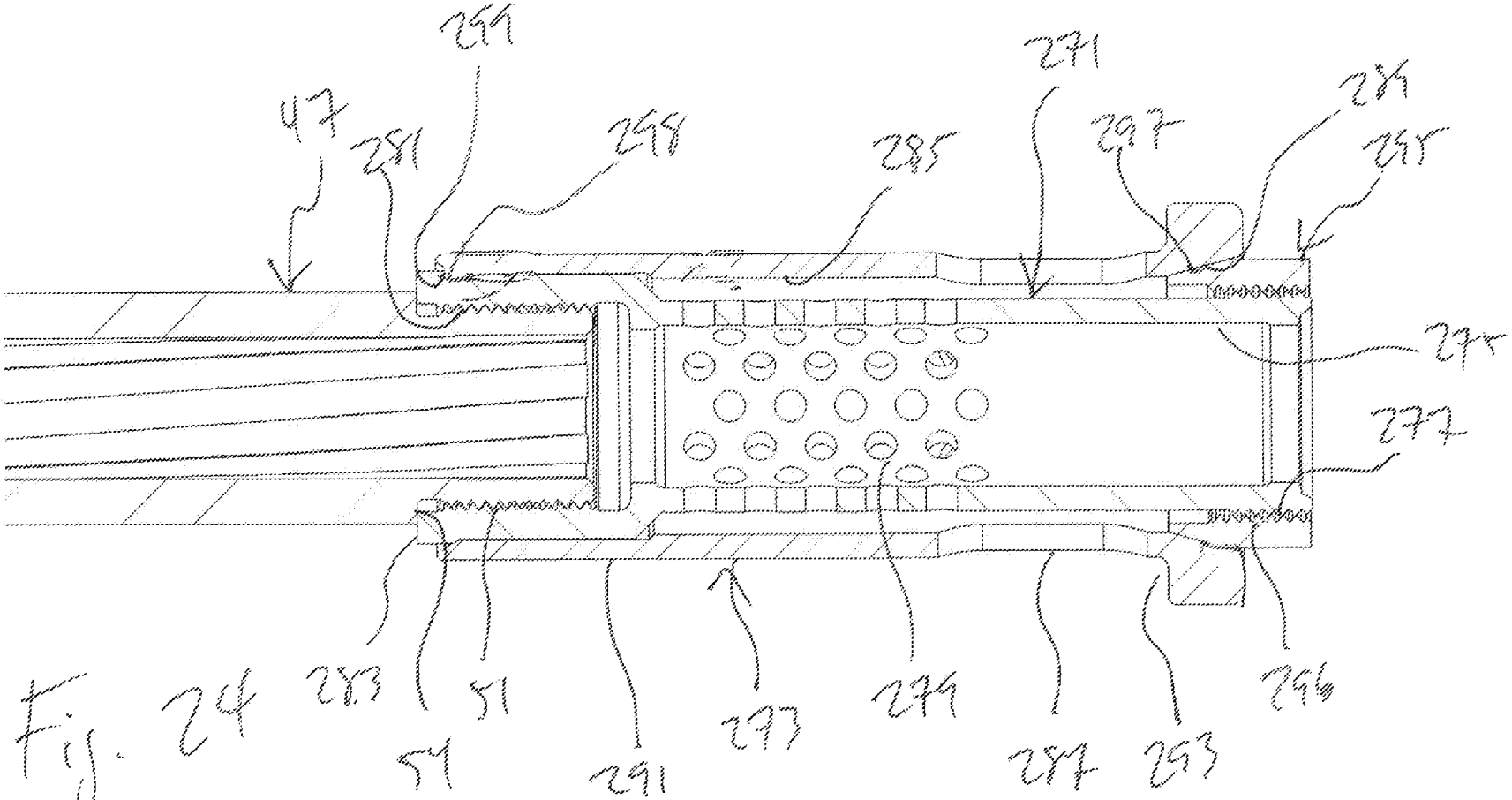

FIGS. 23 and 24 illustrate another embodiment of a piston assembly, comprising core 271 and piston 273. Core 271 has a bore 275, external threads 277 at a forward end, ports 279, internal threads 281 at a rear end configured to engage threads 51 of barrel 47, and a rear surface 283 configured to mate with shoulder 54 of barrel 47. Piston 273 has a bore 285, ports 287, an internal tapered surface 289 at a forward end, an outer surface 291 configured to allow a rear cap to sealingly slide along surface 291, and a shoulder 293 at a forward end. Core 271 is threadingly coupled to barrel 47, and a nut 295 couples piston 273 to core 271. Nut 295 comprises internal threads 296 configured to engage threads 277 of piston 273 and a tapered surface 297, which is configured to mate with tapered surface 289 of piston 273. Piston 273 also comprises an internal tapered surface 298 at the rear end for mating with an external tapered surface 299 on core 271, and piston 273 is captured between tapered surfaces 298, 299 when the piston assembly is assembled. During operation, gases may flow through ports 279, 287 and into interstitial spaces and gaps between components.

Figure 25:
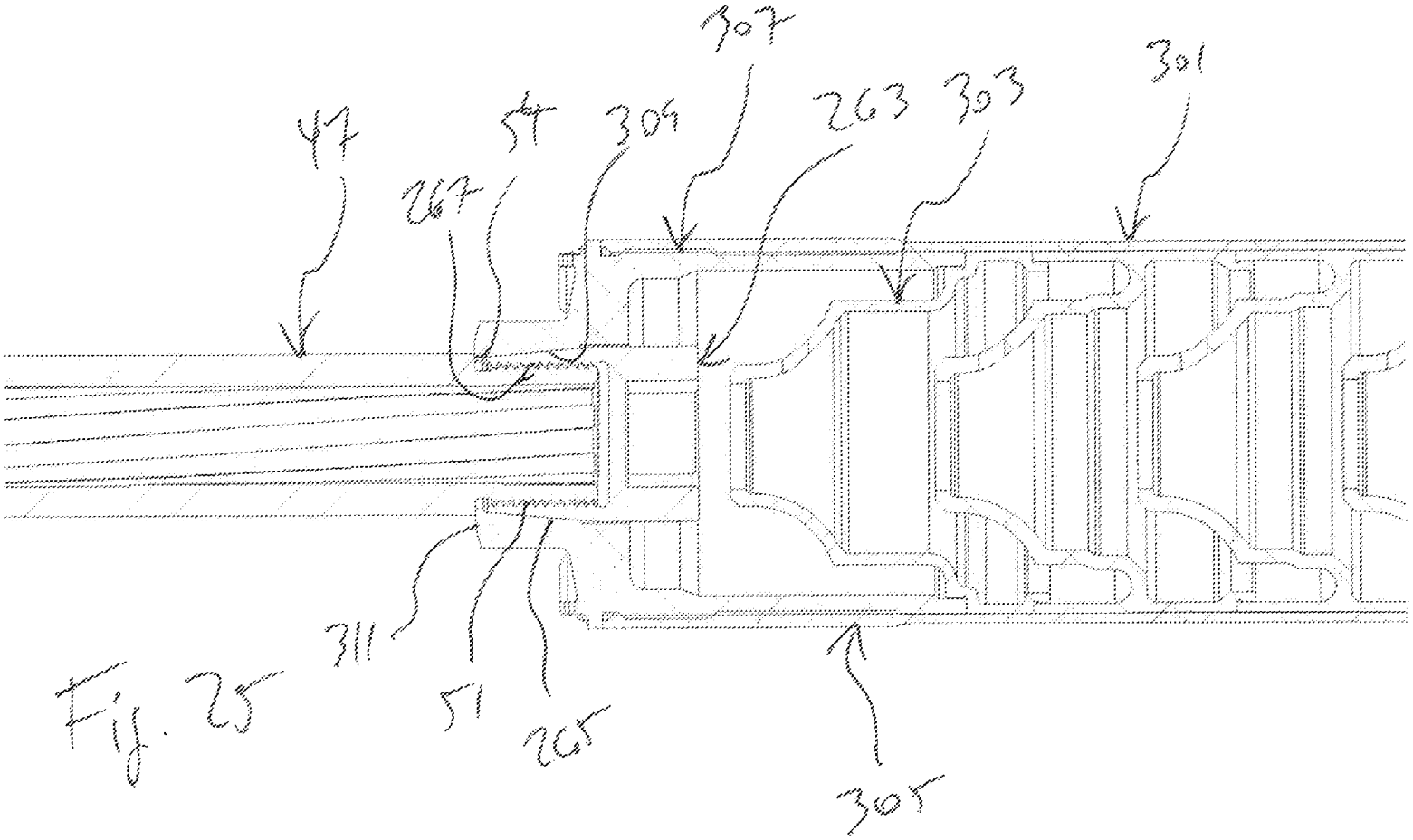
FIG. 25 is a view of an embodiment of a suppressor assembly according to this disclosure.

FIG. 25 illustrates another embodiment of a suppressor assembly according to this disclosure. Suppressor 301 is coupled to barrel 47, and comprises a baffle stack 303, a tube 305, and a rear cap 307. Suppressor 301 does not use a piston assembly but is retained on barrel 47 with nut 295, as described above. Rear cap 307 has an internal tapered surface 309 configured to mate with tapered surface 265 of nut 295 and a rear surface 311 configured to mate with shoulder 54 of barrel 47.

FIGS. 26 through 29 are views of embodiments of a suppressor front cap according to this disclosure. Front caps 401, 403 are configured to be coupled to the forward end of baffle stack 405, comprising baffles 407, 408 threadedly coupled to each other, so that front caps 401, 403 can be interchangeably used to tailor the function of the suppressor. In other embodiments, baffle stack 405 may be formed as a unitary object, such as by additive manufacturing, or as separate components that are permanently joined together, such as by welding. Front caps 401, 403 have threads 409 configured for engaging threads 411 of forwardmost baffle 408. Baffles 407 cooperate to form an outer coaxial chamber 413, and gases within chamber 413 pass into an outer coaxial chamber 415 of baffle 408. A wall 417 defines the forward extent of chamber 415, wall 417 of cap 403 comprising optional ports (FIGS. 28 and 29). In operation, use of cap 403 allows gases to flow from coaxial chamber 413 through chamber 415 and out through ports 419, whereas use of cap 401 prevents gases from flowing forward out of chamber 415. In this manner, a user may alter the back pressure caused by use of the suppressor. While shown as interchangeable caps, 401, 403, cap 403 may be provided with means for partially or fully closing ports 419, including multiple detent positions to allow for precise and repeatable adjustment. In other embodiments, the outer diameter of front caps 401 may be equal to the outer diameter of inner volume 421, allowing gases to exit from coaxial volume 415 through the front of forwardmost baffle 408, and baffle 408 may have ports similar to ports 419 and located at the forward end of coaxial chamber 415. These ports may also be adjustable for partially or fully closing the ports. It should be noted that various means for controlling the amount ports are open will include components rotating about the bore centerline, levers, or other mechanical or electromechanical mechanisms.

FIGS. 30 through 37 are views of an embodiment of a gas block according to this disclosure and embodiments of components configured for assembly therewith.

A gas block 511 is coupled to a barrel 513 for directing ported gases through a tube 515. Gas block 511 is tubular with a bore 517 and comprises a tubular receiver 519 located above the bore and sized for receiving a forward end of tube 515, a plug 520 or other seal or obstruction sealing the forward end. A port 521 extends radially from bore 517 and communicates with an aperture 523 in tube 515. An indexing protrusion 525 is configured for mating with a flat 527 on a mounting portion 529 of barrel 513, mounting portion 529 also having a forward tapered surface 530. Tapered surfaces 531, 532 are located on opposite ends of bore 517, surface 531 configured for mating with surface 530 of mounting portion 529.

Figure 30:
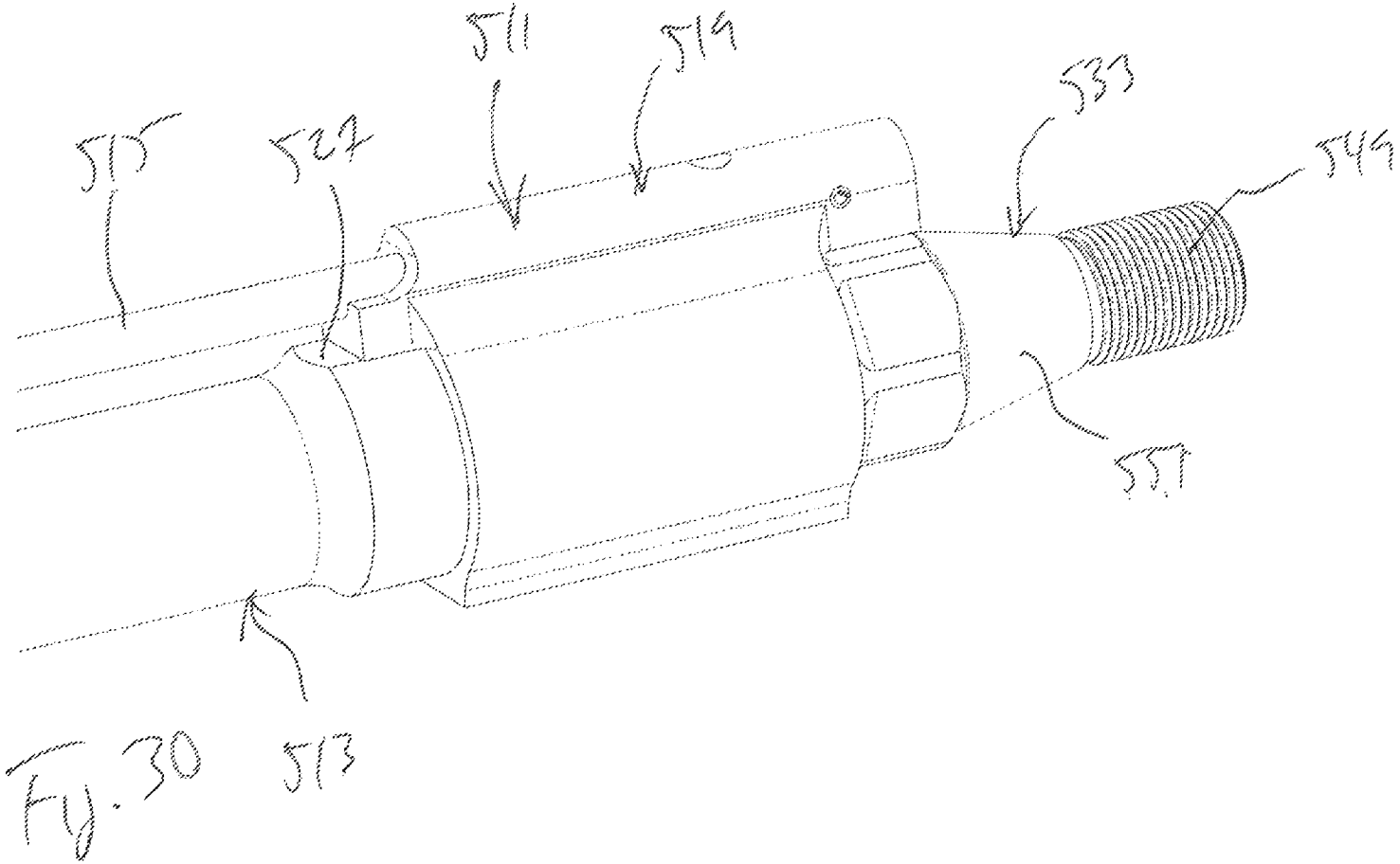
FIGS. 30 through 37 are views of an embodiment of a gas block and embodiments of components configured for assembly therewith, all according to this disclosure.
Figure 31:
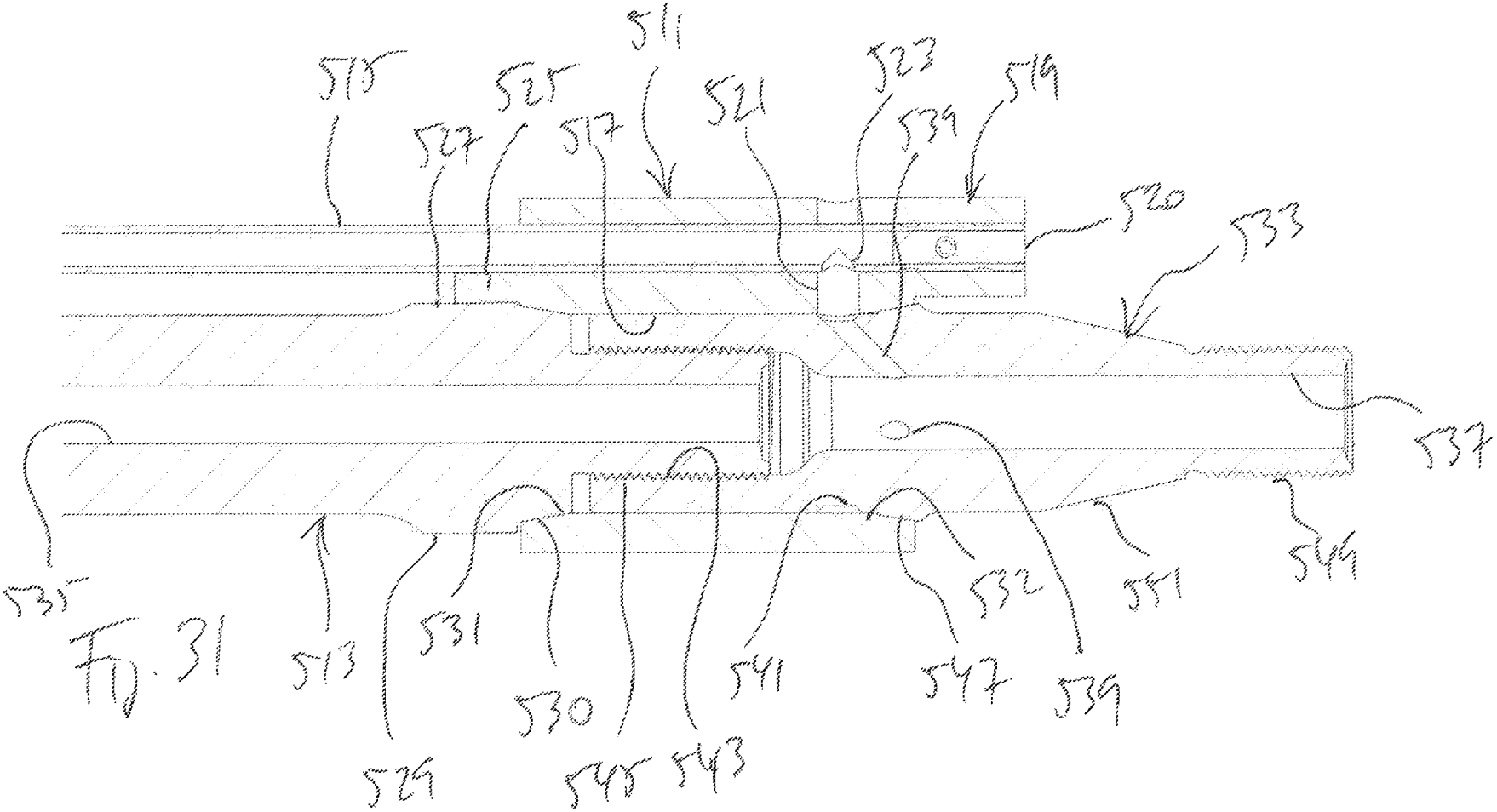

FIGS. 30 and 31 illustrate an extension 533, which is one example of a component configured to retain gas block 511 to barrel 513 and direct gases expelled from bore 535 of barrel 513 to tube 515, and additional components are described below. It should be understood that, in the embodiments shown, the features relating to attachment to barrel 513 and porting gases to tube 515 are identical and identified with the same reference numbers. However, these features may differ between embodiments due to various requirements or desired characteristics.

Extension 533 has a bore 537 and three ports 539 (two visible) for allowing gases to flow from bore 537 to port 521 of gas block 511. Ports 539 may be angled or straight. To eliminate the need for indexing of extension 533, a circumferential groove 541 communicates ports 539 with port 521. Internal threads 543 are configured to engage external threads 545 of barrel 513, and a tapered surface 547 is configured to mate with surface 532. Threads 549 on the forward end of extension 533 are shown as being the same size and thread pitch as threads 545, but threads 549 may alternatively be of a different configuration. This allows items, such as, for example, flash hiders or suppressor mounts, configured to be attached to the end of barrel 513 to be attached to the forward end of extension 533. Extension 533 is shown with a tapered surface 551 adjacent threads 549, though a shoulder or other common mounting feature may be formed on extension 533. When assembled, gas block 511 is captured between tapered surface 530 of mounting portion 529 and tapered surface 547 of extension 533.

Figure 32:
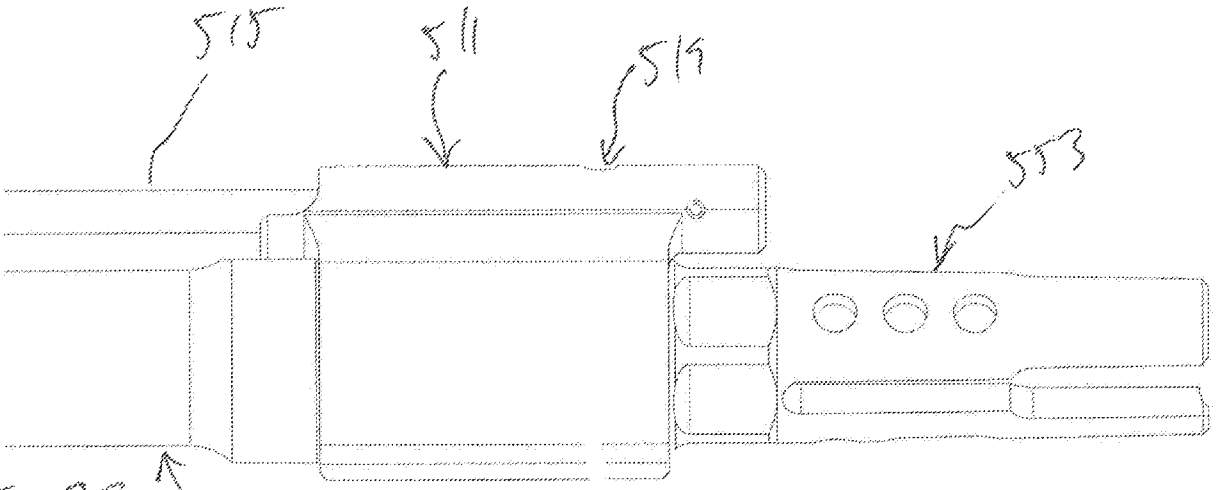
Figure 33:
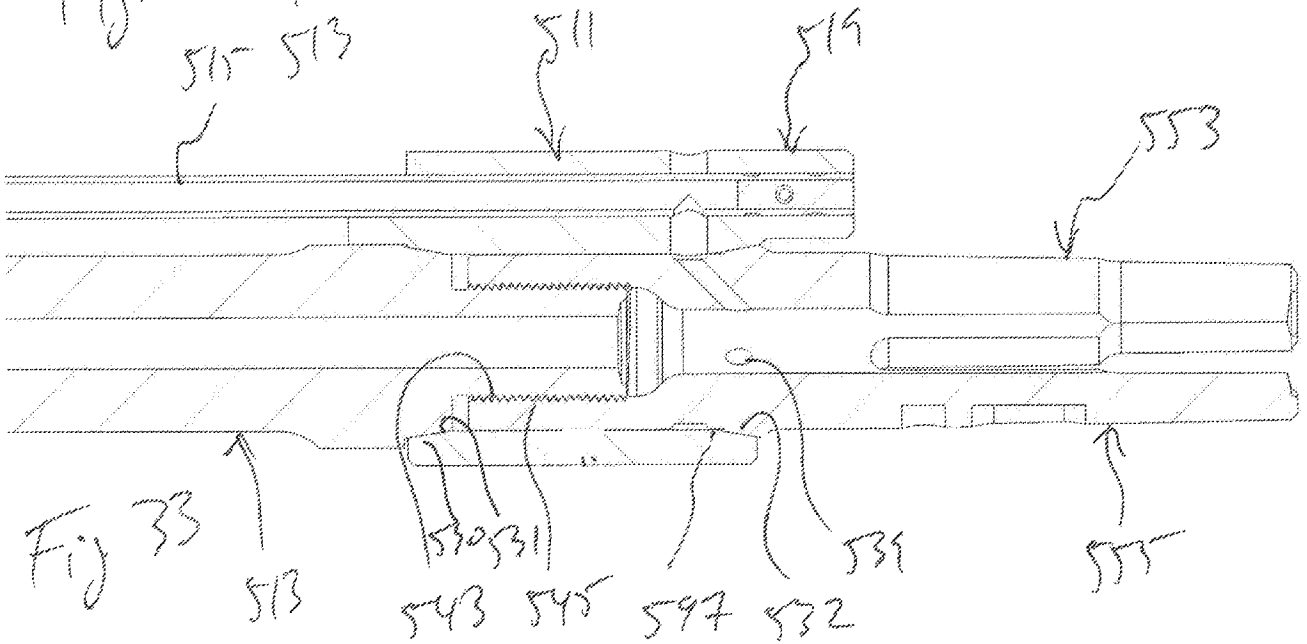

FIGS. 32 and 33 illustrate gas block 511 retained by flash hider component 553, the rear portion of which is constructed identically to extension 533, as described above. A forward portion of component 553 forms a 3-prong flash hider 555.

Figure 34:
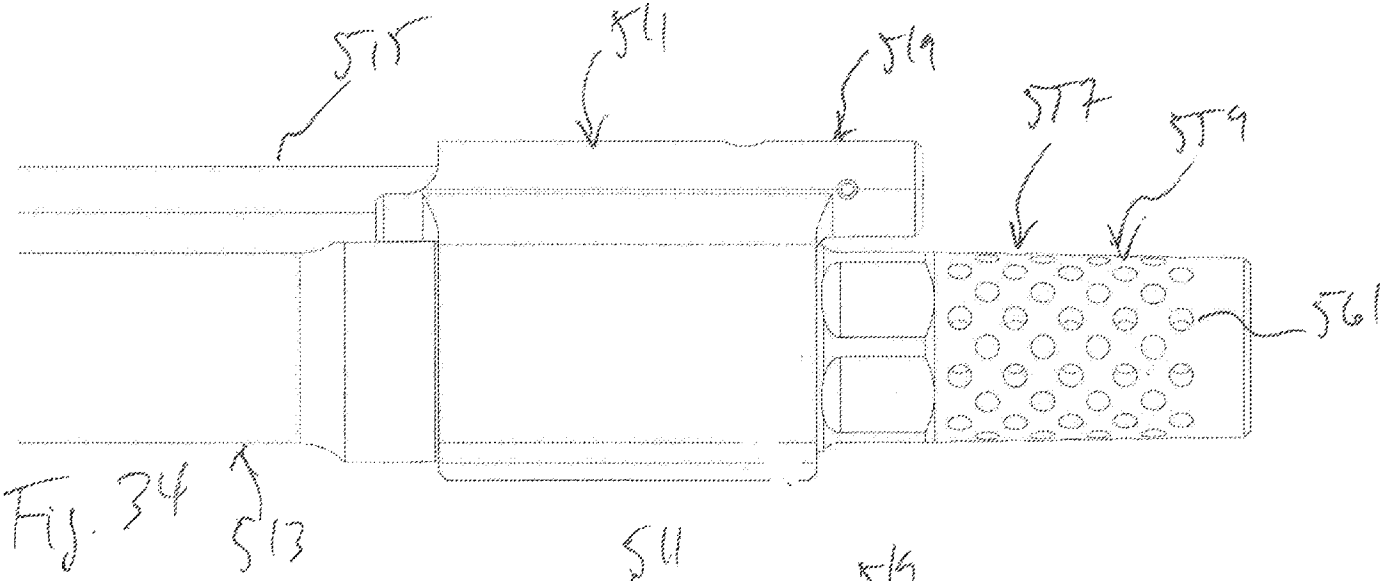
Figure 35:
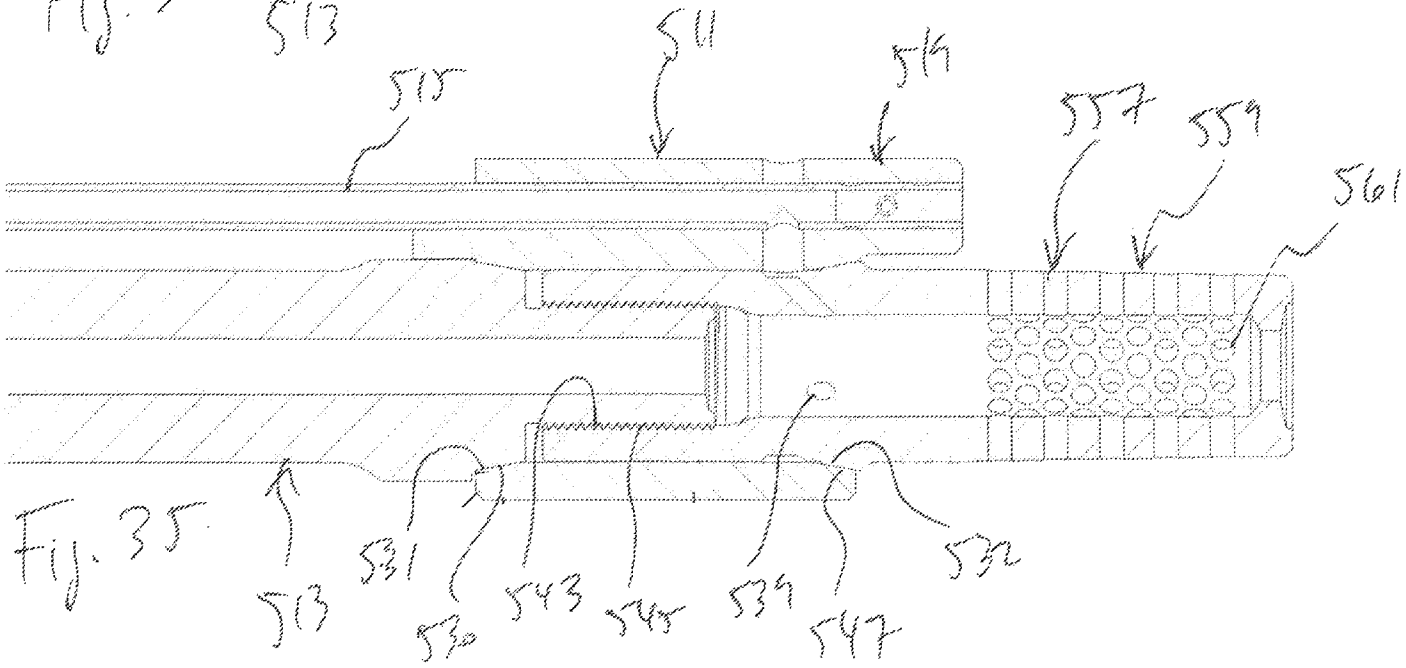

FIGS. 34 and 35 illustrate gas block 511 retained by muzzle brake component 557, the rear portion of which is constructed identically to extension 533, as described above. A forward portion of component 557 forms a muzzle brake 559 having radial ports 561.

Figure 36:
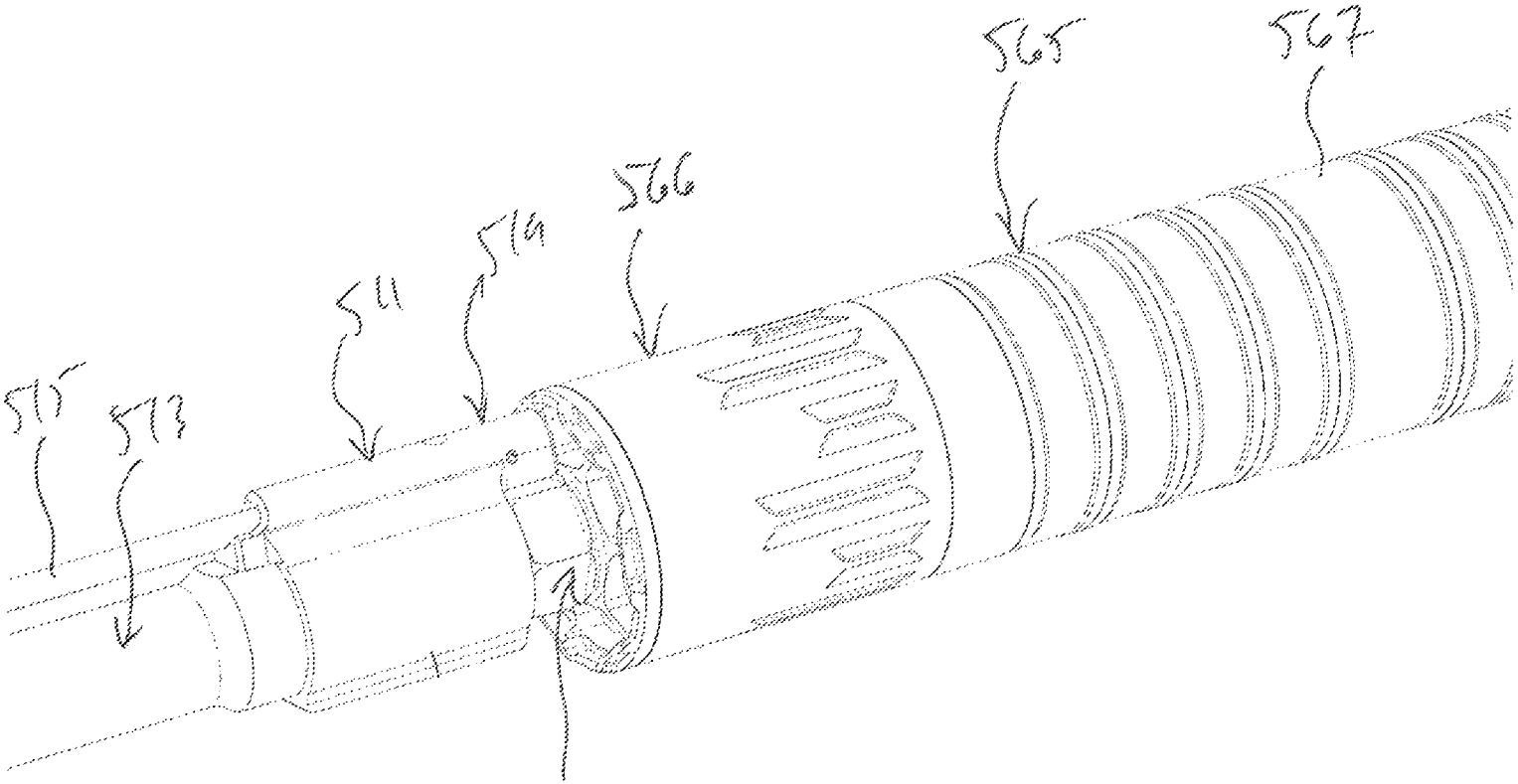
Figure 37:
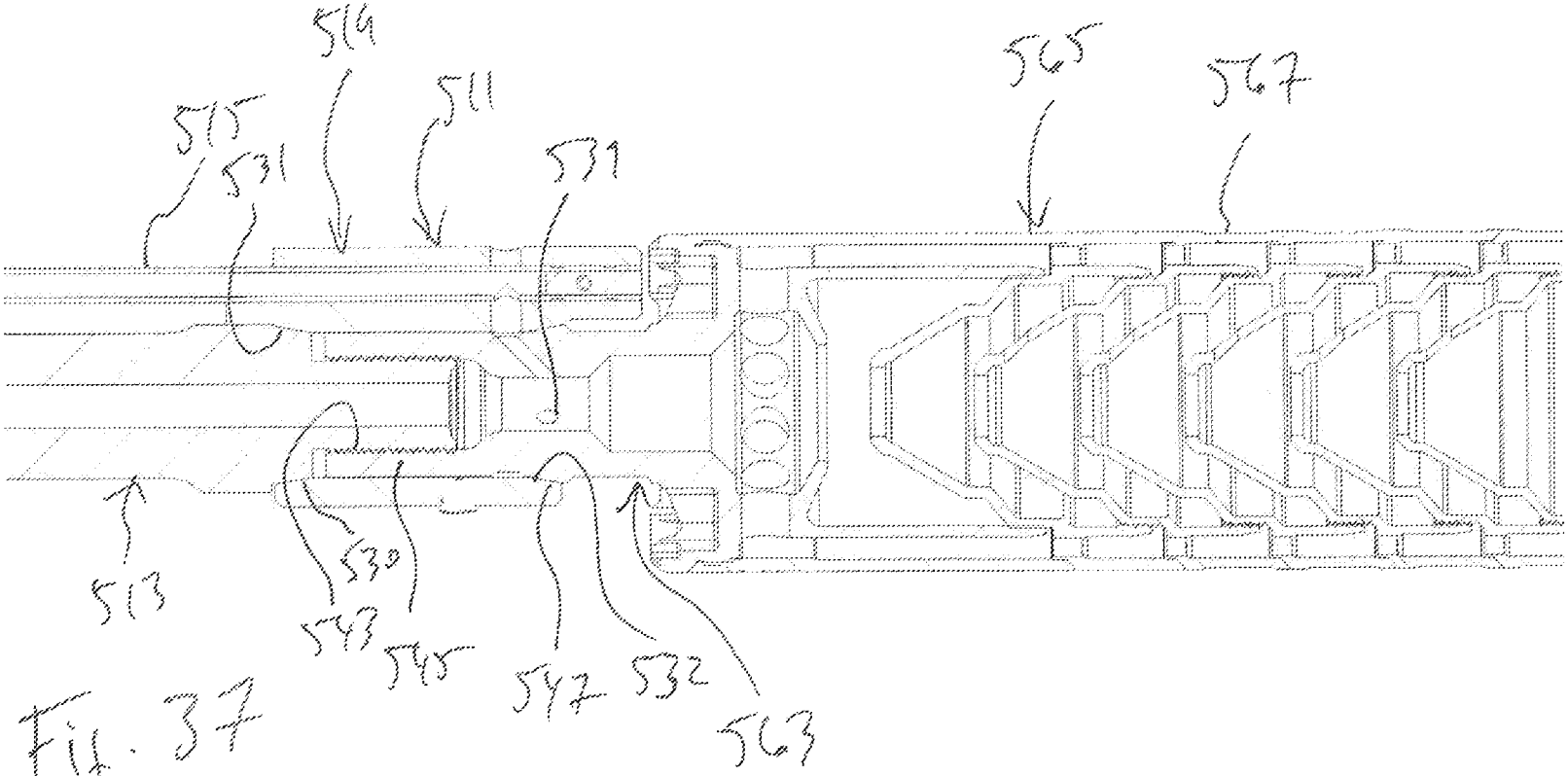

FIGS. 36 and 37 illustrate gas block 511 retained by rear cap 563 for suppressor 565, the rear portion of cap 563 being constructed identically to extension 533, as described above. A forward portion of rear cap 563 provides for attachment of a full-length suppressor tube or, as shown, a shroud 566 and threadedly coupled baffles 567. Rear cap 563 may be formed as multiple pieces or integral, as shown in the figures.

It should be noted that gas block 511 may have an adjustable component for adjusting gas pressure provided to the receiver of the firearm. Other types of indexing features (e.g., protrusion and slot, pin, etc.) may be used to index gas block 511 relative to the receiver. Additionally, components used with gas block 511 may have common 90-degree shoulders for compatibility with existing products, a taper as shown, or other angled features. Though shown as a direct-impingement system sending gases to the firearm receiver for unlocking a bolt, gas block 511 may alternatively comprise a piston mechanism operated by the gases and causing translation of a rod that unlocks the bolt.

FIGS. 38 through 42 are views of an embodiment of a suppressor according to this disclosure, suppressor 601 comprising suppressor body 603, front cap 605, and a rear cap (not shown). As shown, suppressor body 603 is configured as a single piece, whether body 603 is formed as a unitary object, such as by additive manufacturing, or as separate components that are permanently joined together, such as by welding. Alternatively, suppressor body may be constructed as separate components configured like baffle stack 405 of FIGS. 28 and 29 and retained together with, for example, threaded couplings or by being captured between front cap 605 and the rear cap.

Body 603 comprises a baffle stack 607 formed from baffles 609 that cooperate to form an outer coaxial expansion chamber 611 between an outer tube 613 and an inner wall 615. Inner wall 615 encloses a central expansion chamber 617. An optional support wall 619 defines the forward extent of chamber 611, wall 619 comprising ports 621. Internal threads 623 are formed with a forward portion of body 603, and an internal tapered shoulder 625 is formed on a forward end.

In the embodiment shown, cap 605 comprises a cap portion 627, an adjuster 629, and a nut 631. External threads 633 are formed at the rear of cap portion 627 for engaging internal threads 623 of body 603 to removably couple cap 605 to body 605. A port flange 635 is formed on the periphery of cap portion 627, flange 635 comprising elongated ports 637 and external tapered shoulder 639 configured to sealingly engage shoulder 625 of body 603. A central bore 641 is formed in cap portion 627, and external threads 643 are formed on a forward end of cap portion 627 and configured for engaging internal threads 645 formed in nut 631. A ring of external teeth 647 are formed adjacent threads 643.

Adjuster ring 629 is formed as a flat ring having opposing port covers 649 and teeth 651 configured to engage teeth 647 of cap portion 627. When assembled, a flange 653 on nut 631 sealingly retaining adjuster ring 629 between flange 653 and a forward surface 659 of flange 635 of cap portion 627 while allowing for rotation of adjuster ring 629 relative to cap portion 627. Engagement of teeth 651 of adjuster ring 629 and teeth 647 of cap portion 627 provides for selective angular positioning of adjuster ring 629 relative to cap portion 627, allowing for precise and repeatable adjustment. In the embodiment shown, adjustment is accomplished by loosening nut 631, moving adjuster ring 629 forward to disengage teeth 647, 651, rotating ring 629 to the desired position, and tightening nut 631 to move ring 629 rearward and reengage teeth 647, 651. Alternatively, a ratcheting engagement may be used, wherein, for example, teeth 651 are biased toward teeth 647 or a biased detent assembly is used to engage teeth 647.

Figure 38:
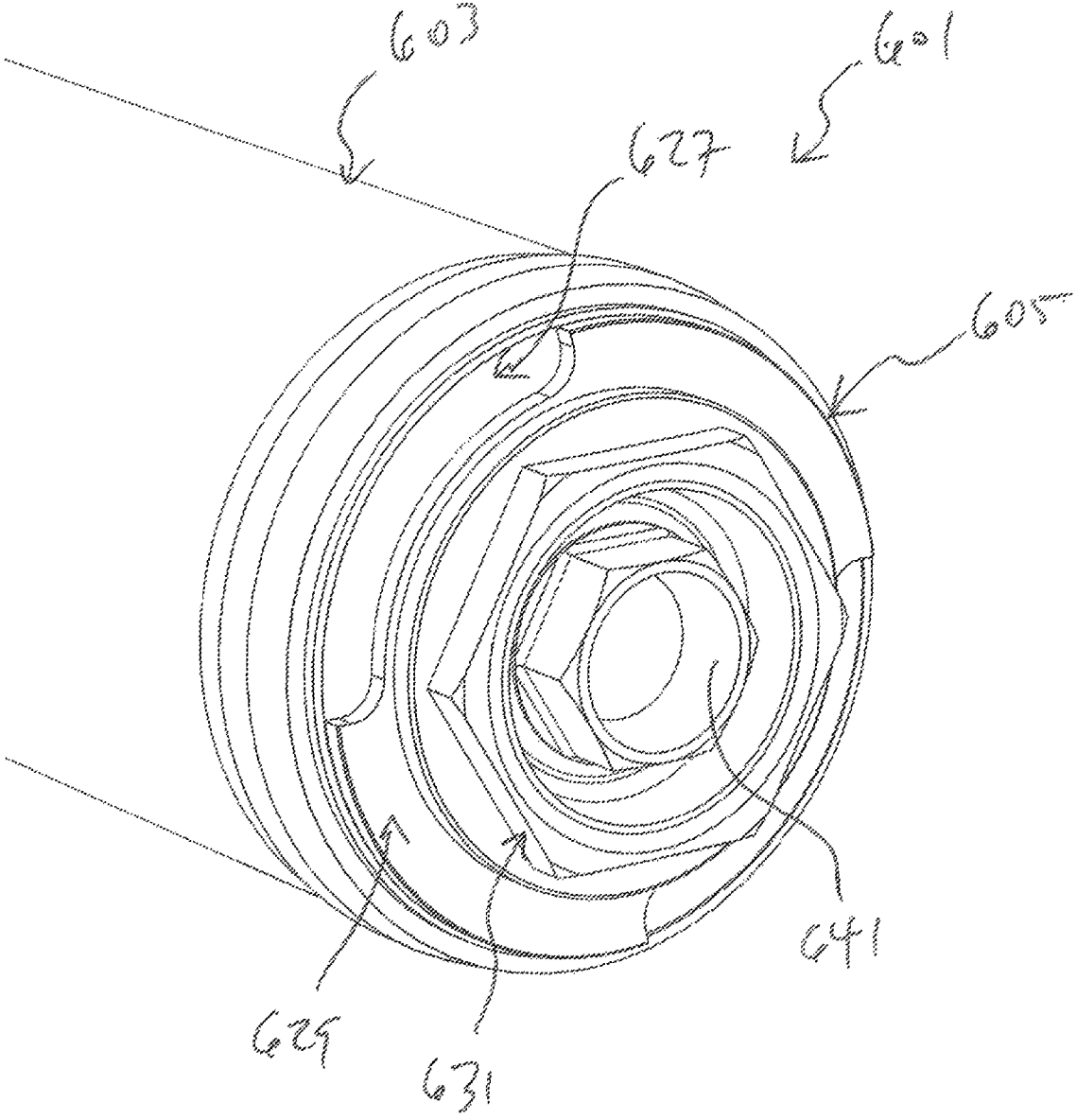
Figure 34:
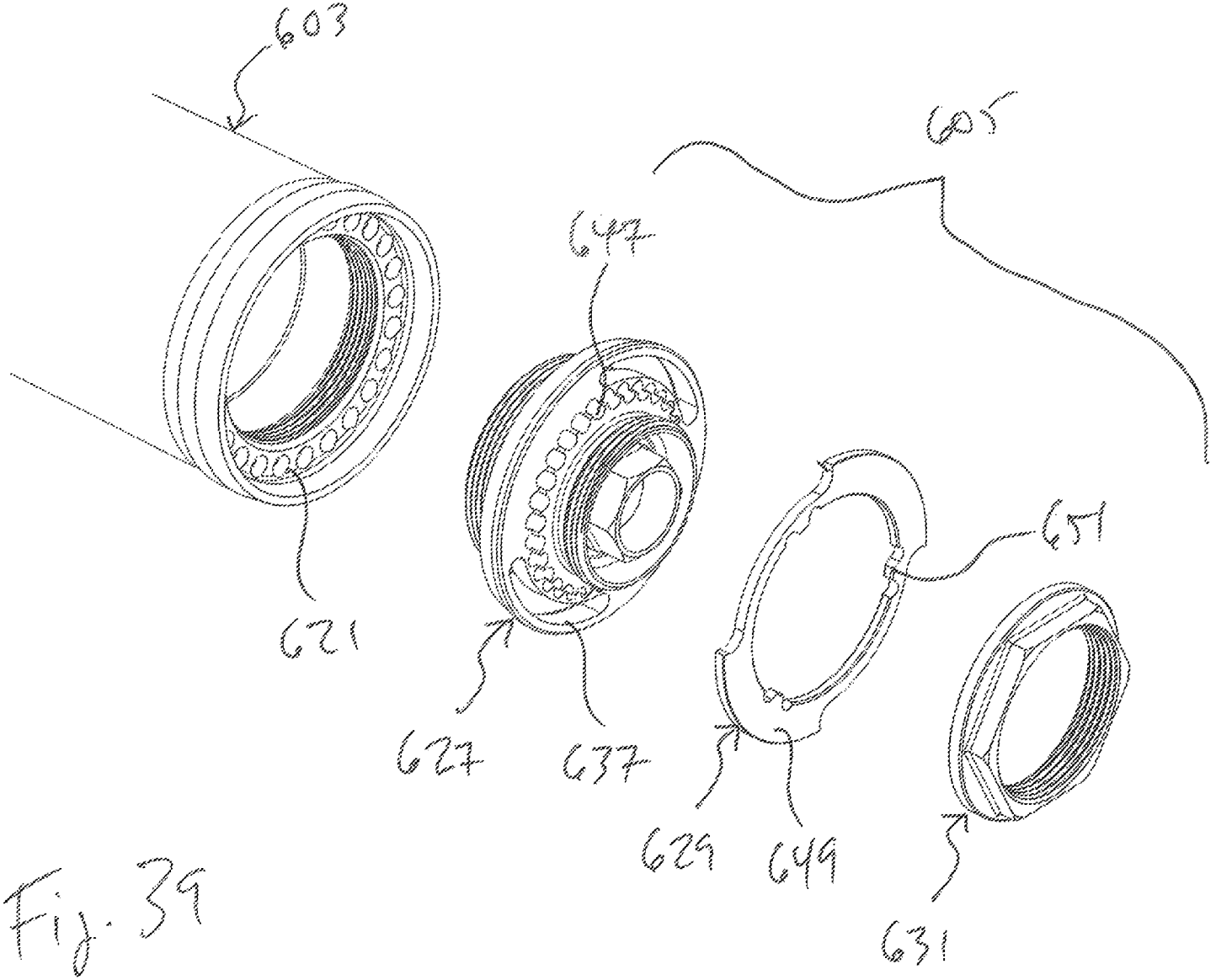
Figure 40:
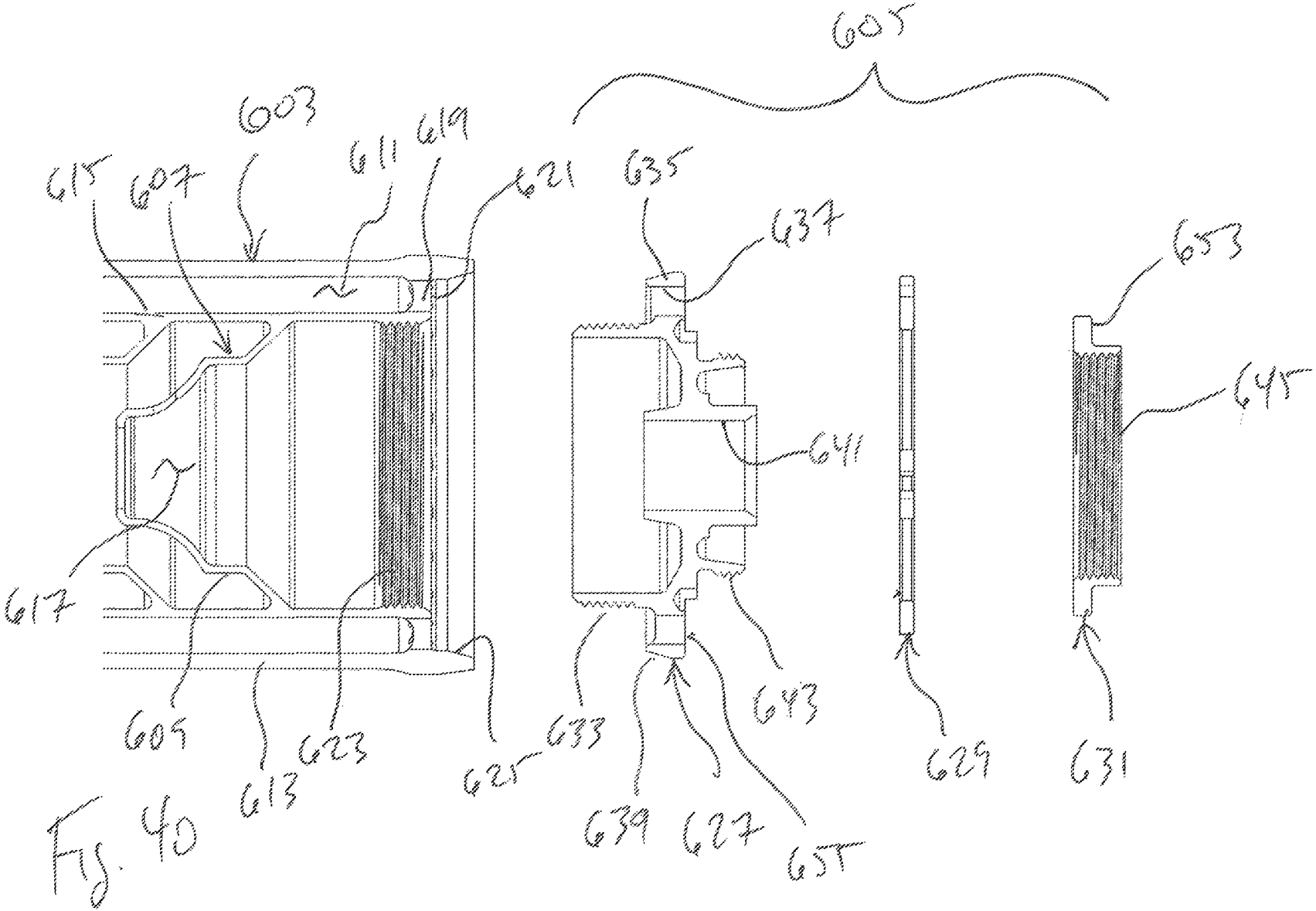
Figure 41:
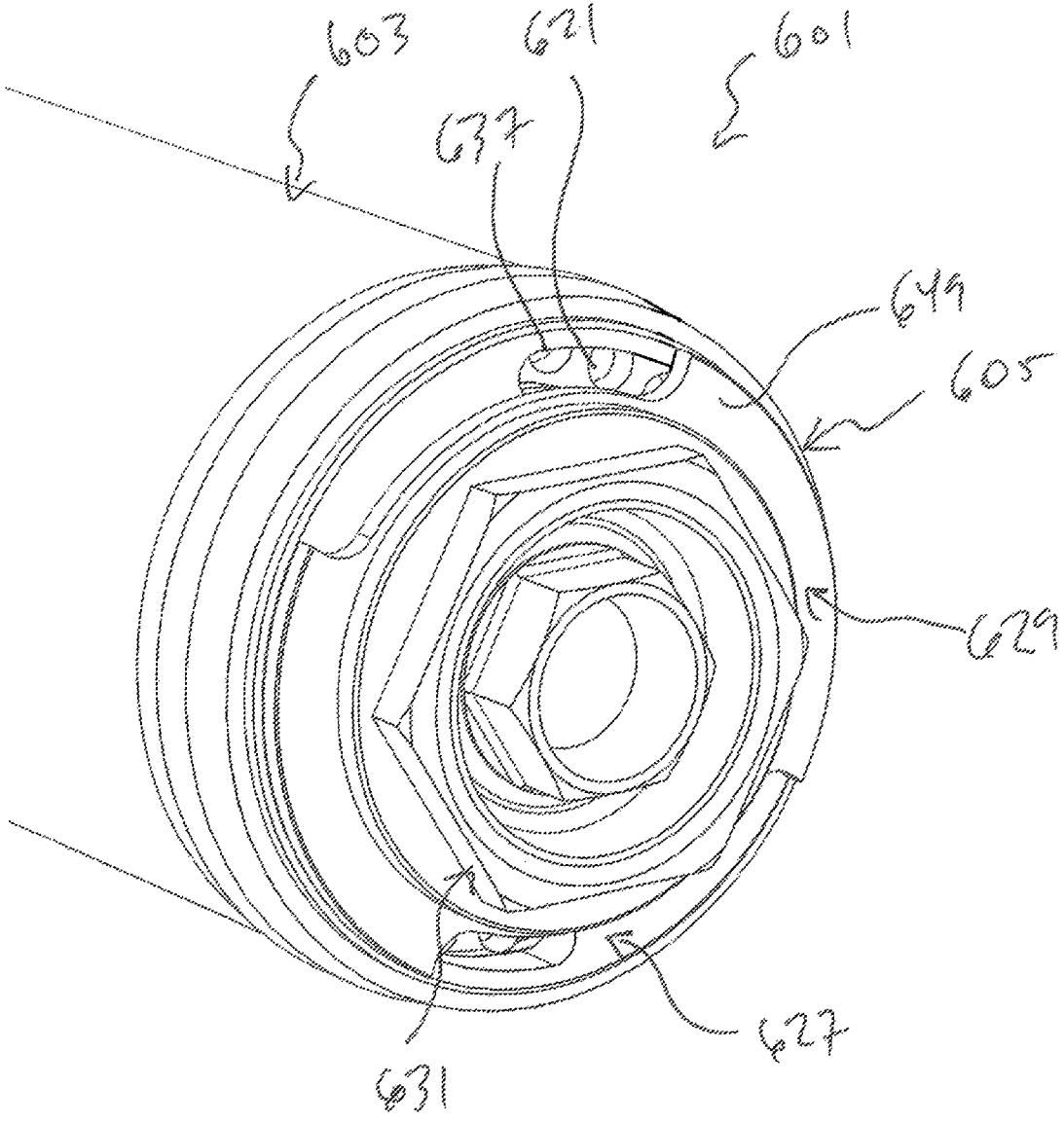
Figure 42:
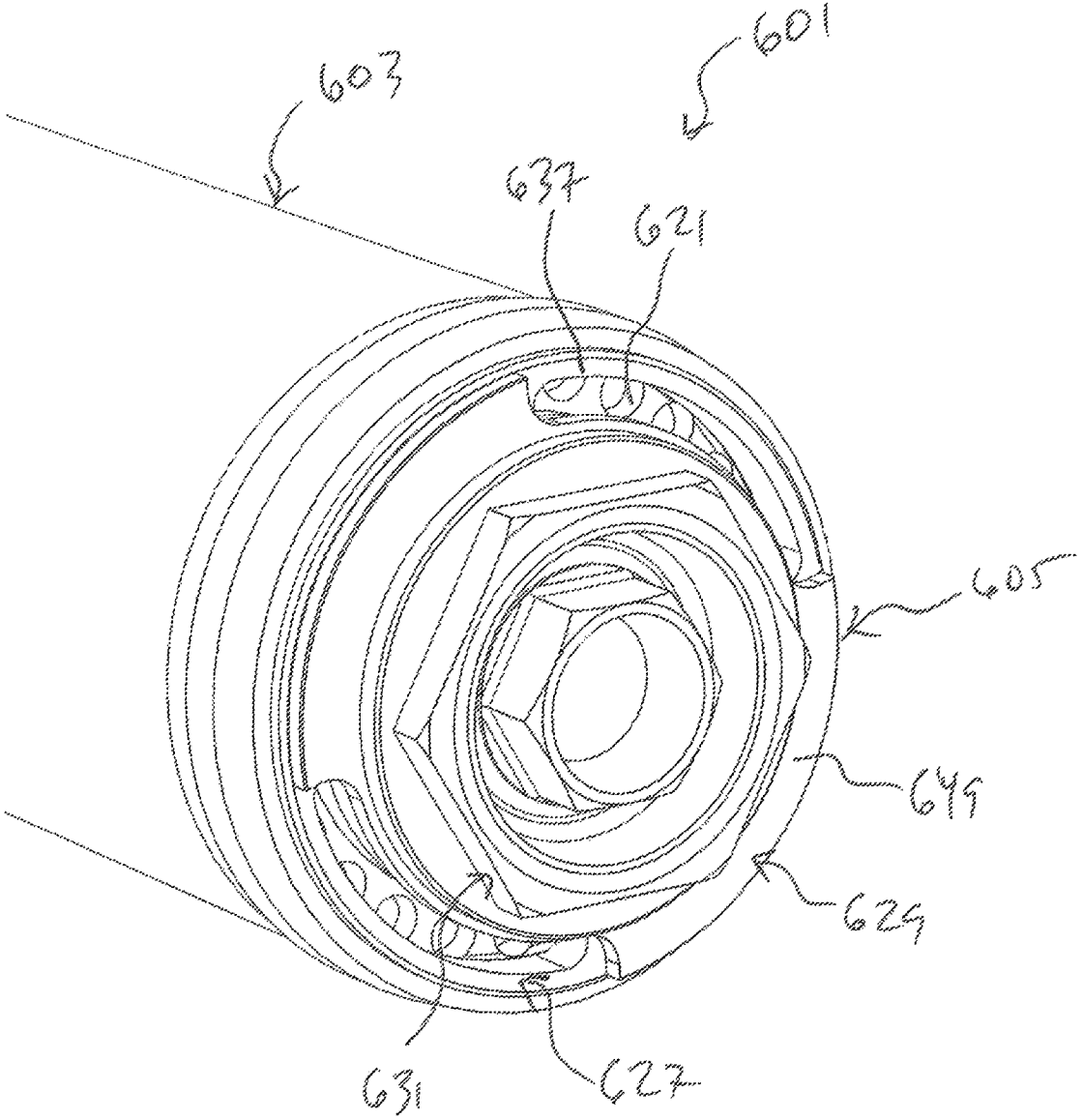
Figure 43:
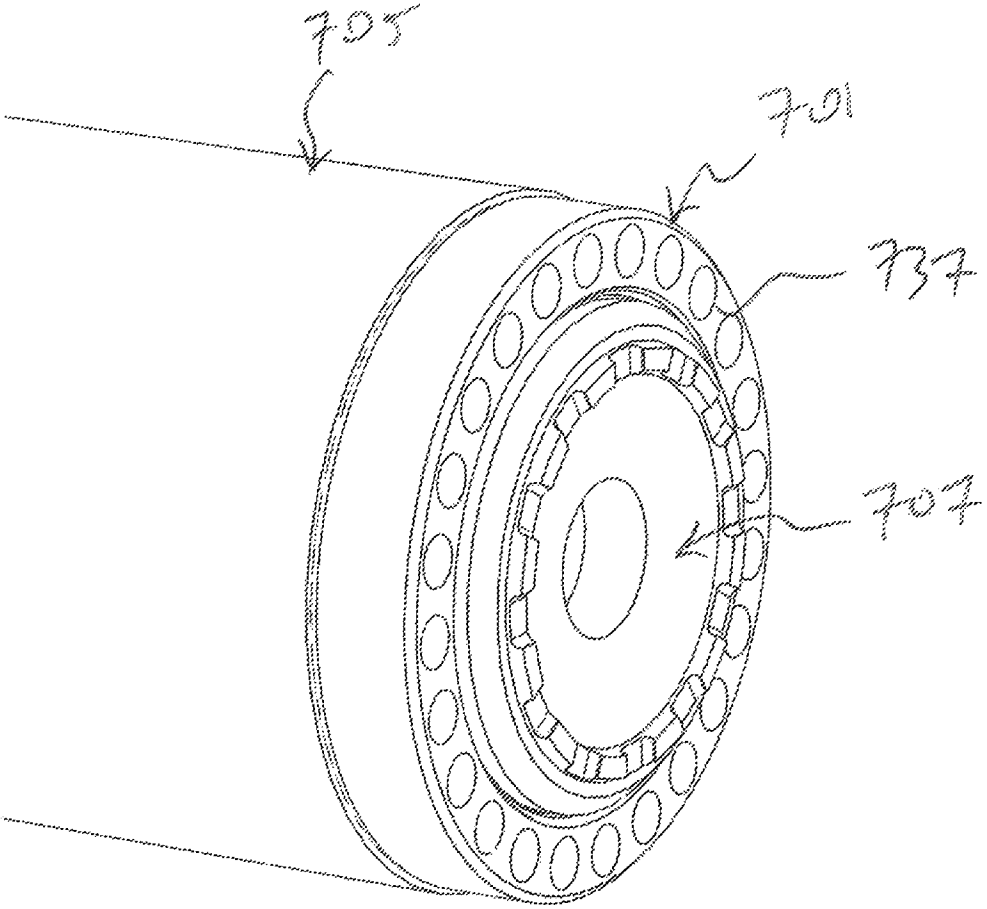
FIGS. 43 through 46 are views of embodiments of a suppressor assembly according to this disclosure.
Figure 44:
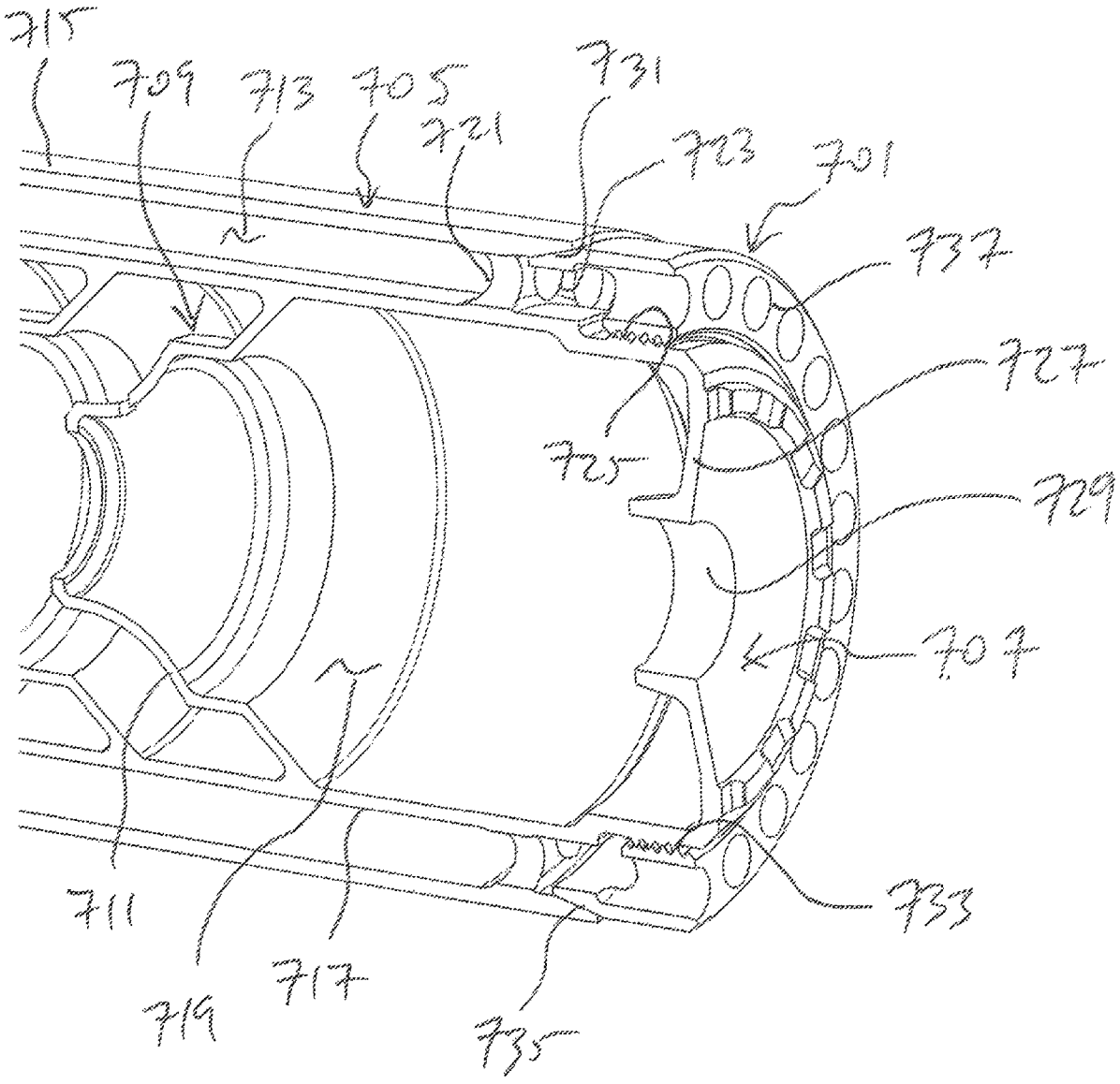
Figure 45:
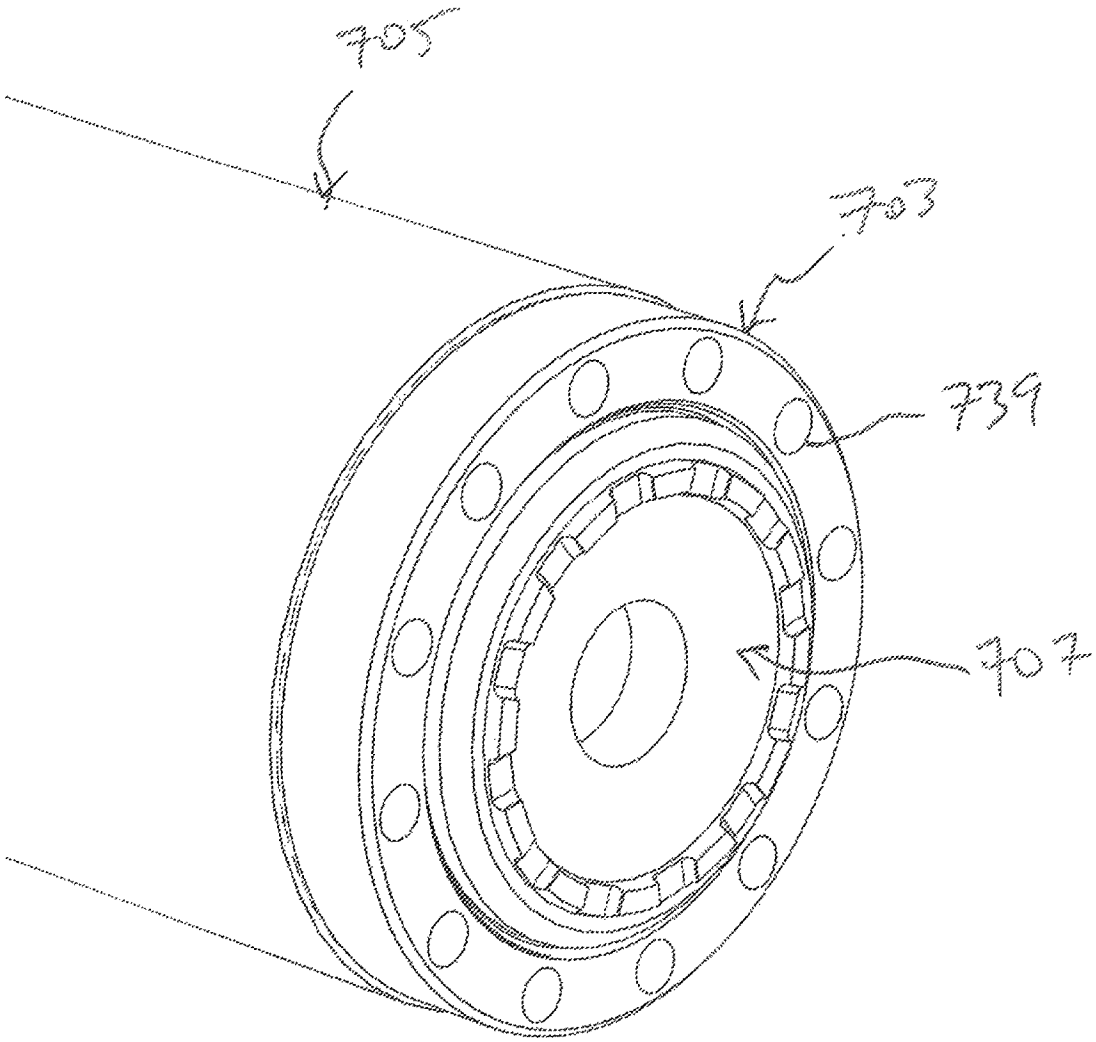
Figure 46:
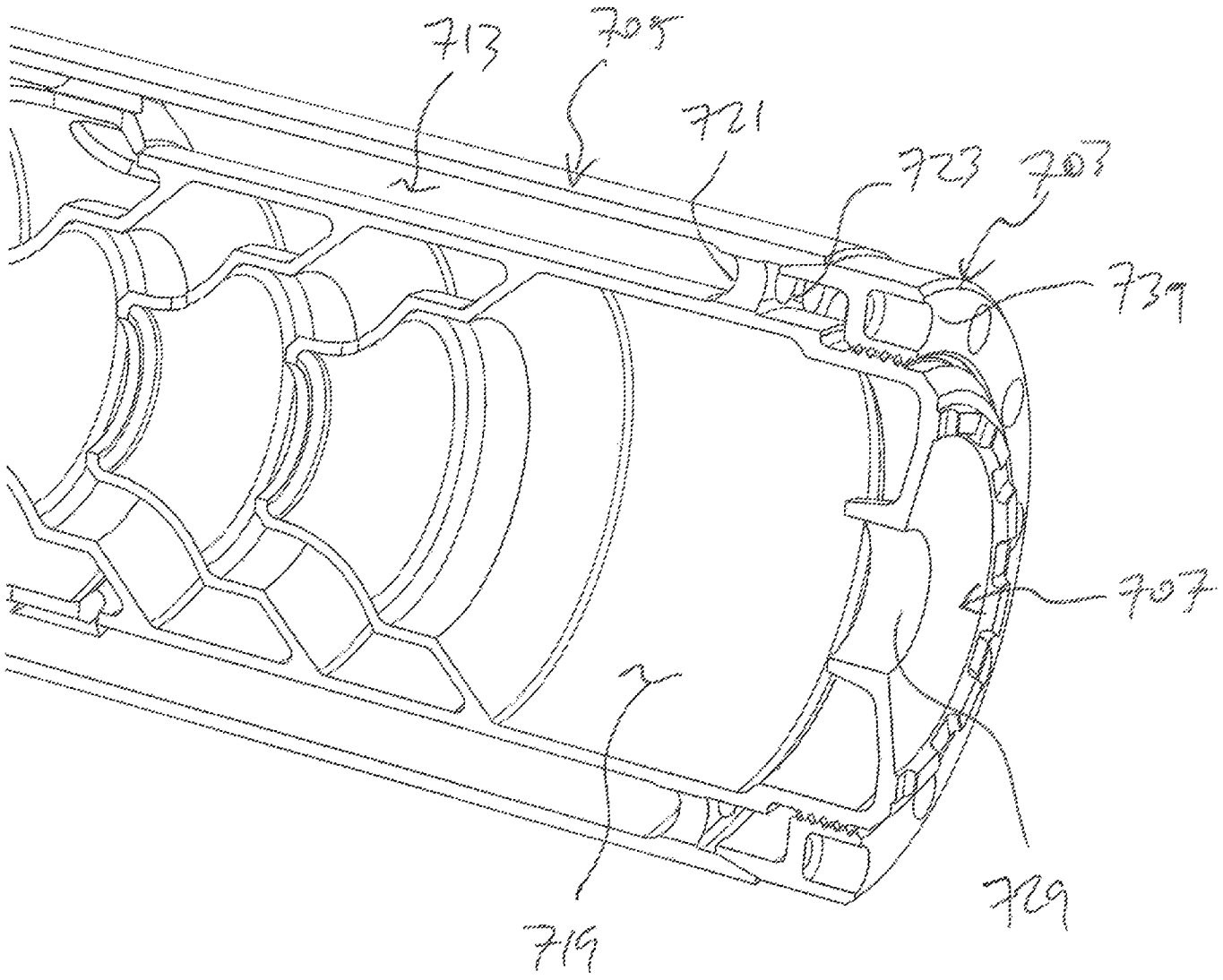
Figure 94:
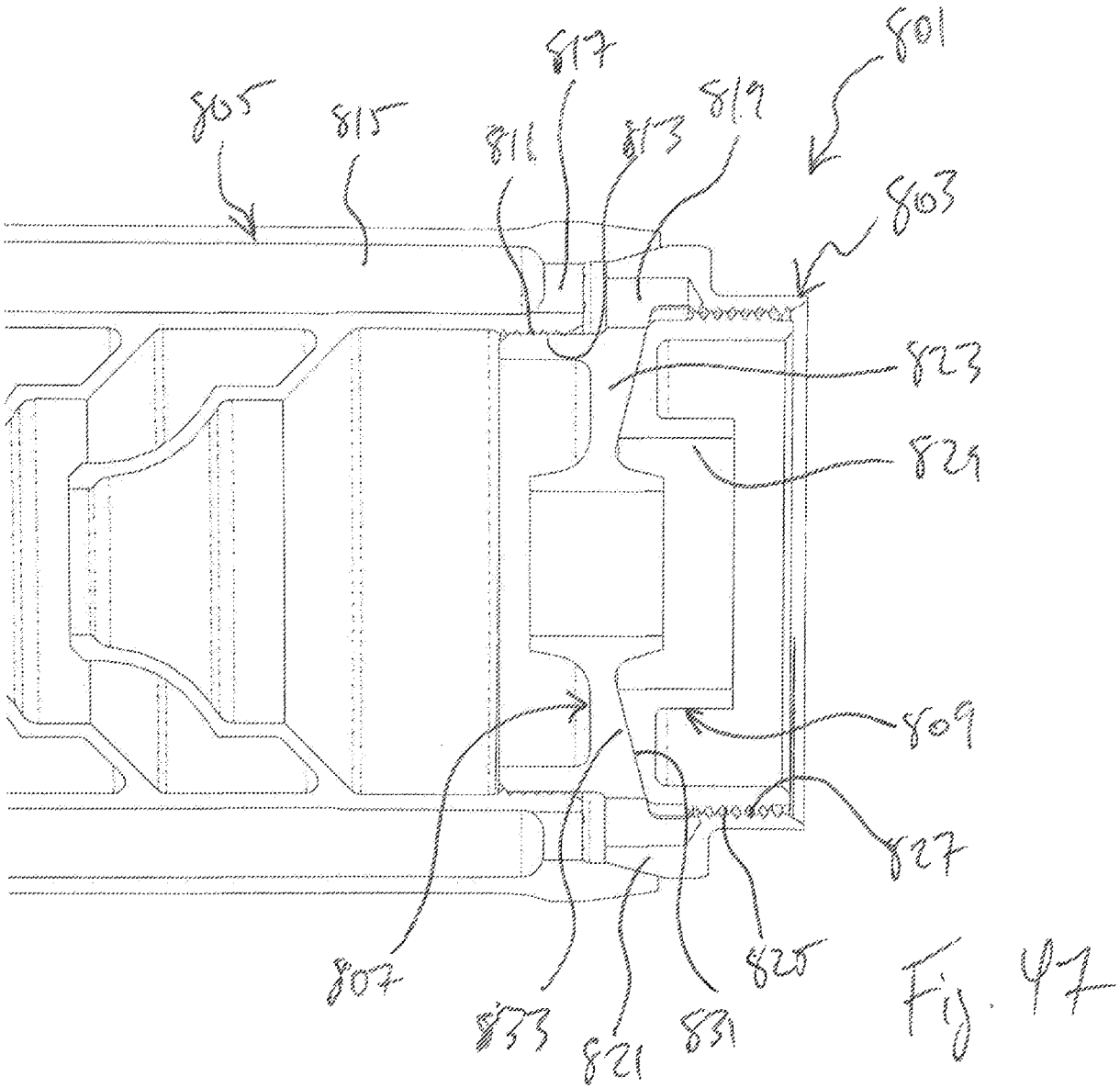
Figure 46:
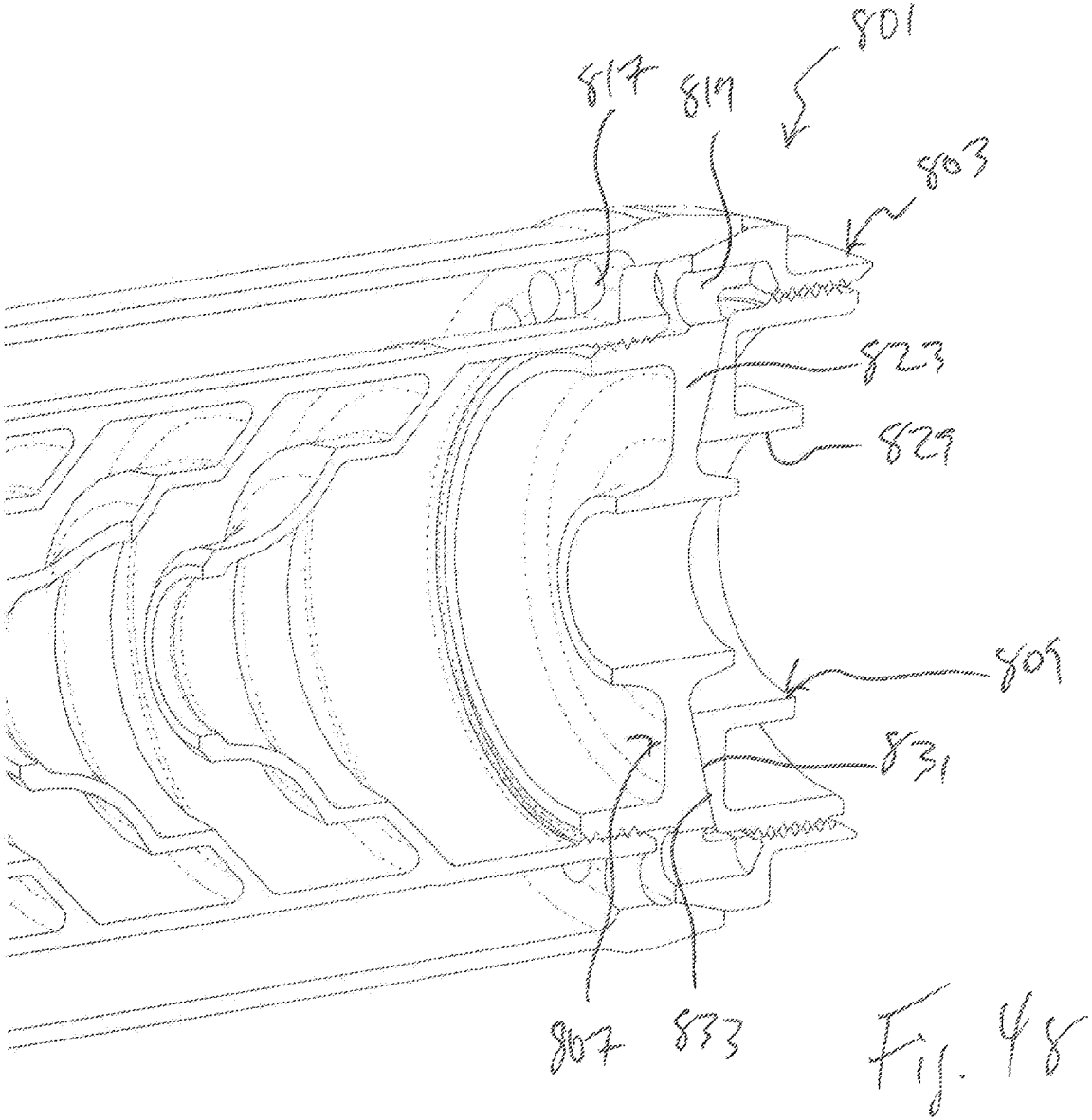
Figure 49:
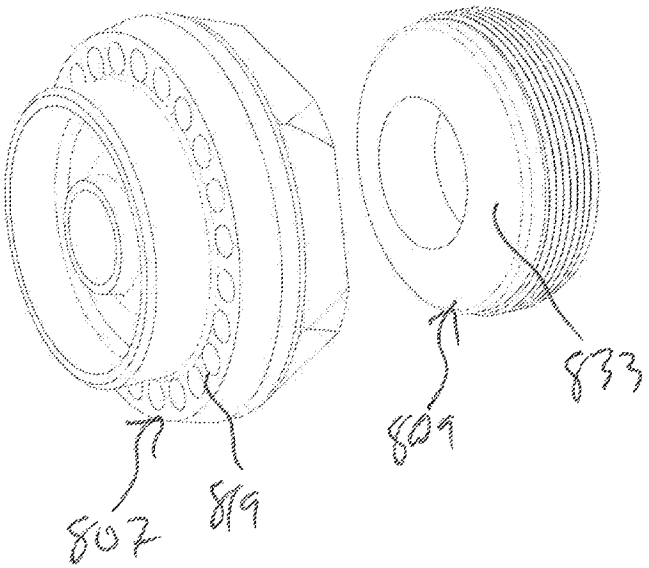
Figure 50:
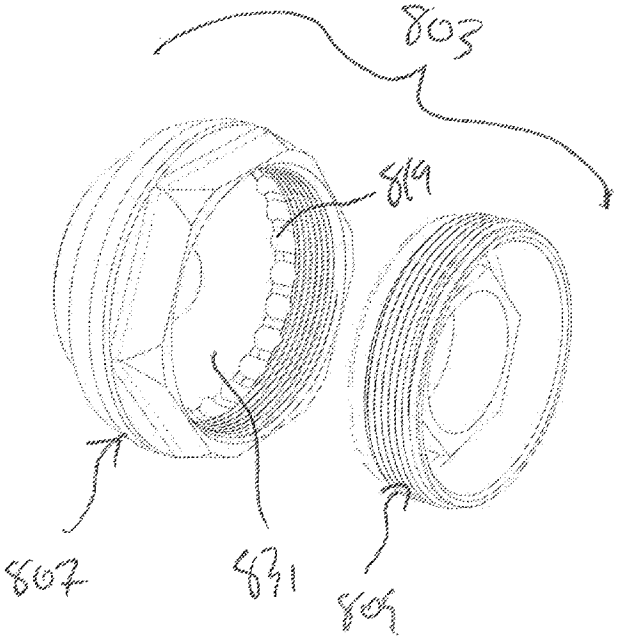
Figure 57B:
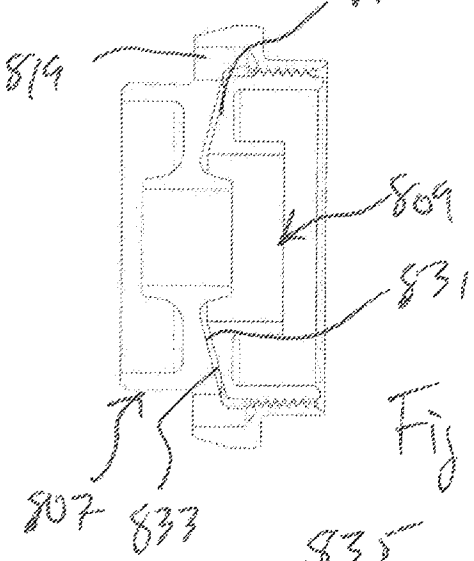
Figure 57D:
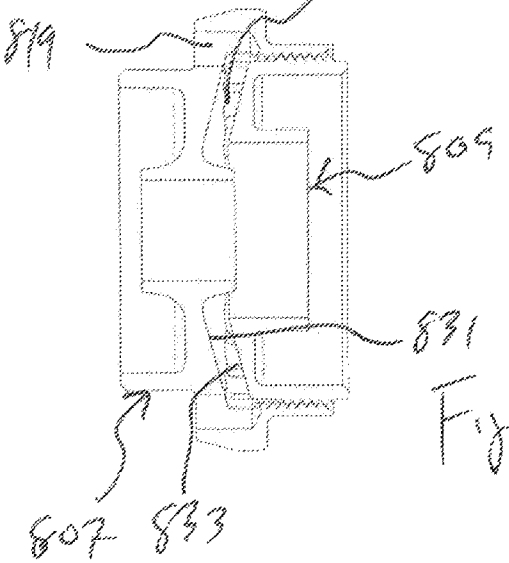
Figure 57A:
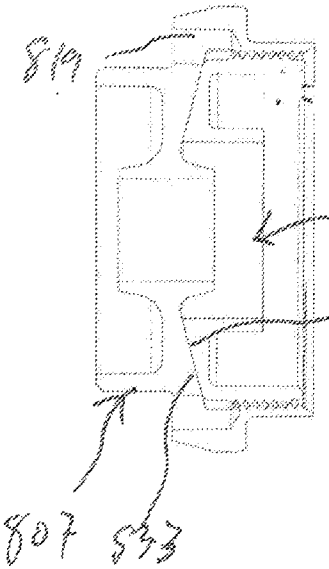
Figure 57C:
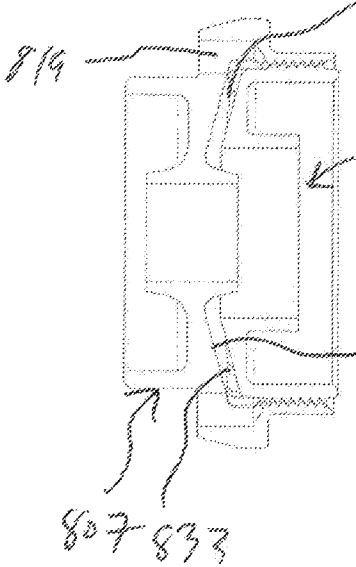
Figure 72:
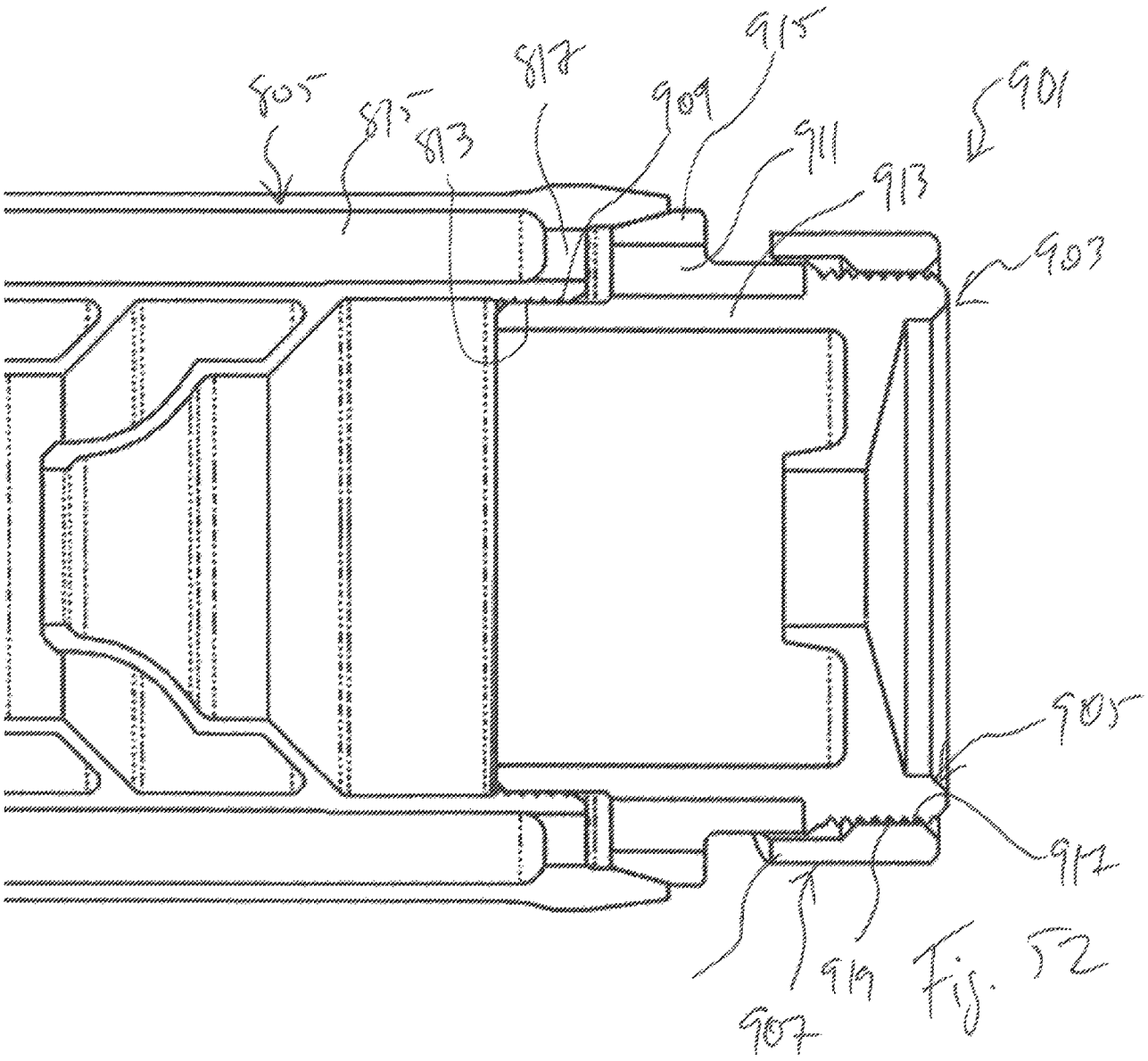

In operation, use of cap 605 allows for selective control of the flow of gases and particulates from coaxial chamber 611 and exiting suppressor 601 through ports 637 of cap 605, allowing for the user to alter the back pressure caused by use of suppressor 601. In FIG. 38, adjuster ring 629 is shown as rotated to position port covers 649 for completely covering elongated ports 637, thereby blocking flow of gases through ports 637. FIGS. 41 and 42 show adjuster ring 629 rotated to position port covers 649 in intermediate and fully open configurations, respectively, in which elongated ports 637 are partially covered or uncovered by covers 629. It should be noted that various means can be used for causing rotation of adjuster ring 629, such as a grip ring, levers or other mechanical or electromechanical mechanisms.

FIGS. 43 through 46 are views of embodiments of a suppressor according to this disclosure and having an integral front cap and interchangeable rings for controlling the flow of gases and particulates from a coaxial expansion chamber. Rings 701, 703 are configured to be coupled to a suppressor body 705 at a forward cap portion 707. Like body 603, body 705 comprises a baffle stack 709 formed from baffles 711 that cooperate to form an outer coaxial expansion chamber 713 between an outer tube 715 and an inner wall 717. Inner wall 717 encloses a central expansion chamber 719. An optional support wall 721 defines the forward extent of chamber 713, wall 721 comprising ports 723. To form cap portion 707, inner wall 717 continues forward of support wall 721 and has external threads 725 formed thereon, and an integral cap plate 727 is formed at the forward end of inner wall 717 for enclosing the end of chamber 719. A bore 729 is formed in cap plate 727, and an internal tapered shoulder 731 is formed on a forward end of tube 715.

Rings 701, 703 are each formed as a cylinder, with internal threads 733 configured to engage external threads 725 of body 705 and an external tapered shoulder 735 for sealingly engaging tapered shoulder 731 of body 705. Ring 701 has ports 737, which allow gases and particulates to flow from coaxial chamber 713 and exit body 705 through ring 701. Ring 703, however, has blind holes 739 formed therein, preventing gases and particulates from exiting chamber 713 through ring 703. Thus, rings 701, 703 are interchangeable for allowing a user to alter the back pressure caused by use of the suppressor. Alternatively, ring 703 may be removed to allow flow from chamber 713, though use of ring 701 provides protection for threads 725. Ports 737 and blind holes 739 may be used to receive portions of a tool for installation or removal of rings 701, 703. While shown as an integral portion of body 705, it should be understood that cap portion 707 may be formed as a removable component and, for example, threadingly coupled to body 705.

FIGS. 47 through 55 are views of embodiments of suppressors having an adjustable front cap according to this disclosure.

Figure 26:
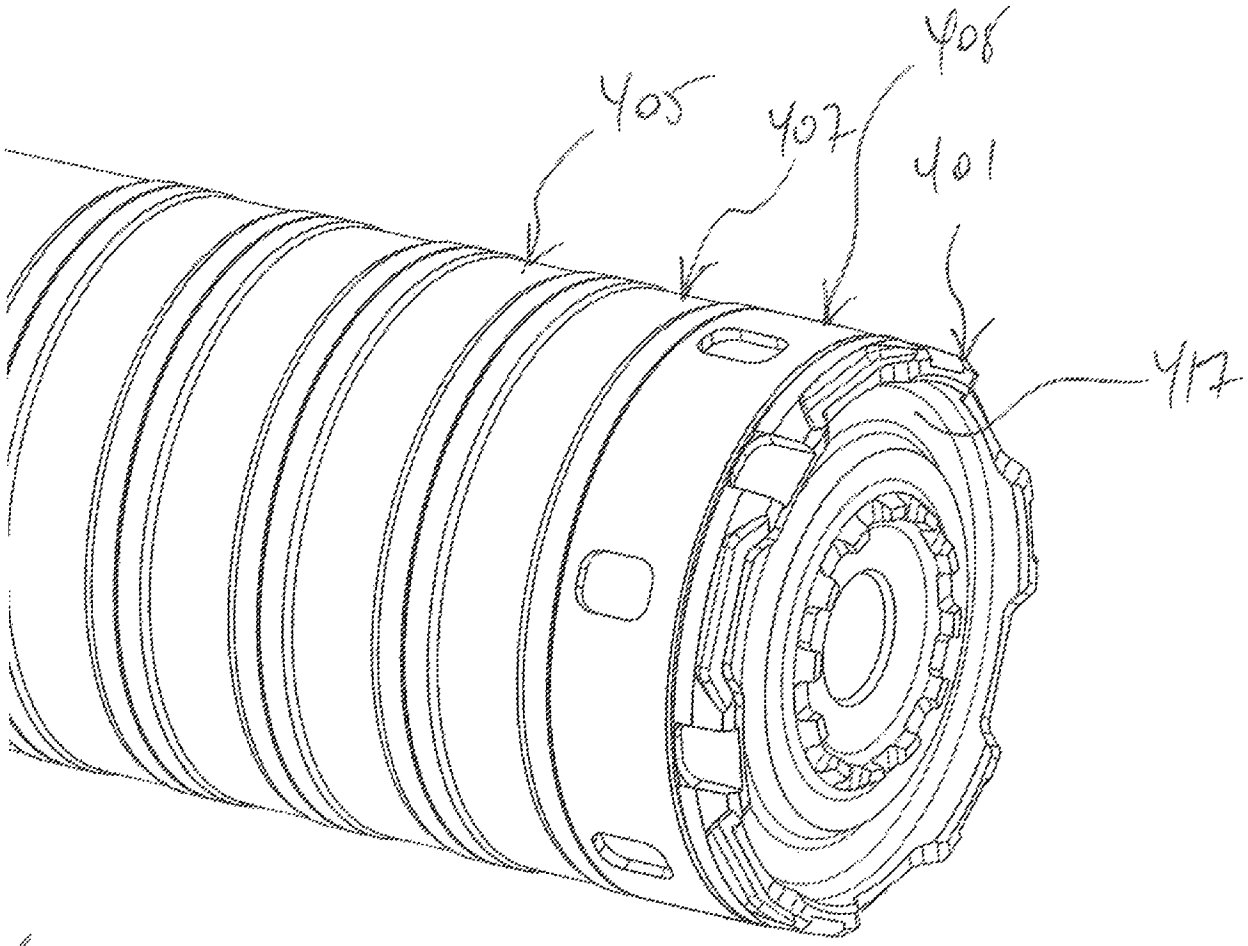
Figure 27:
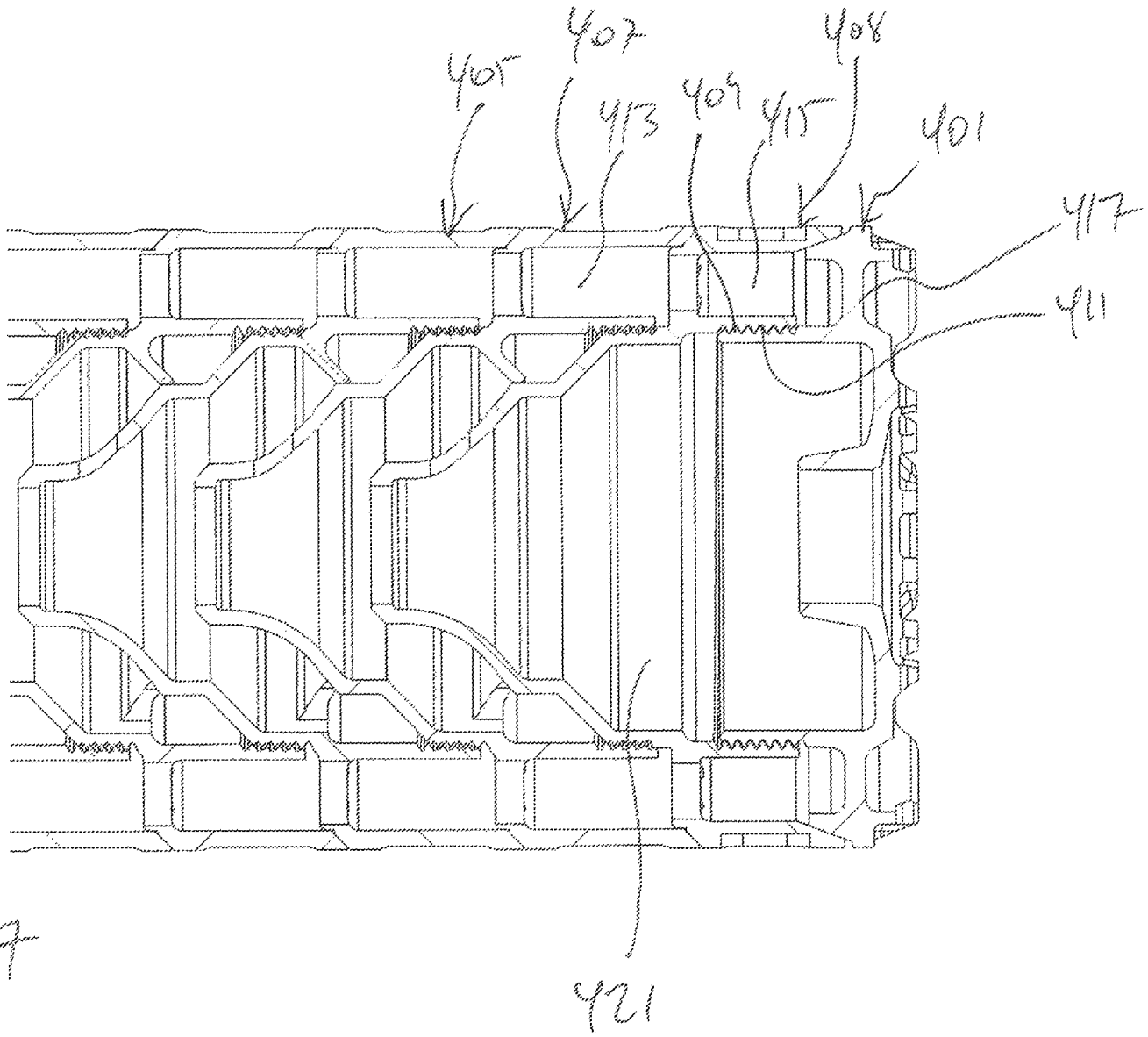
Figure 27:
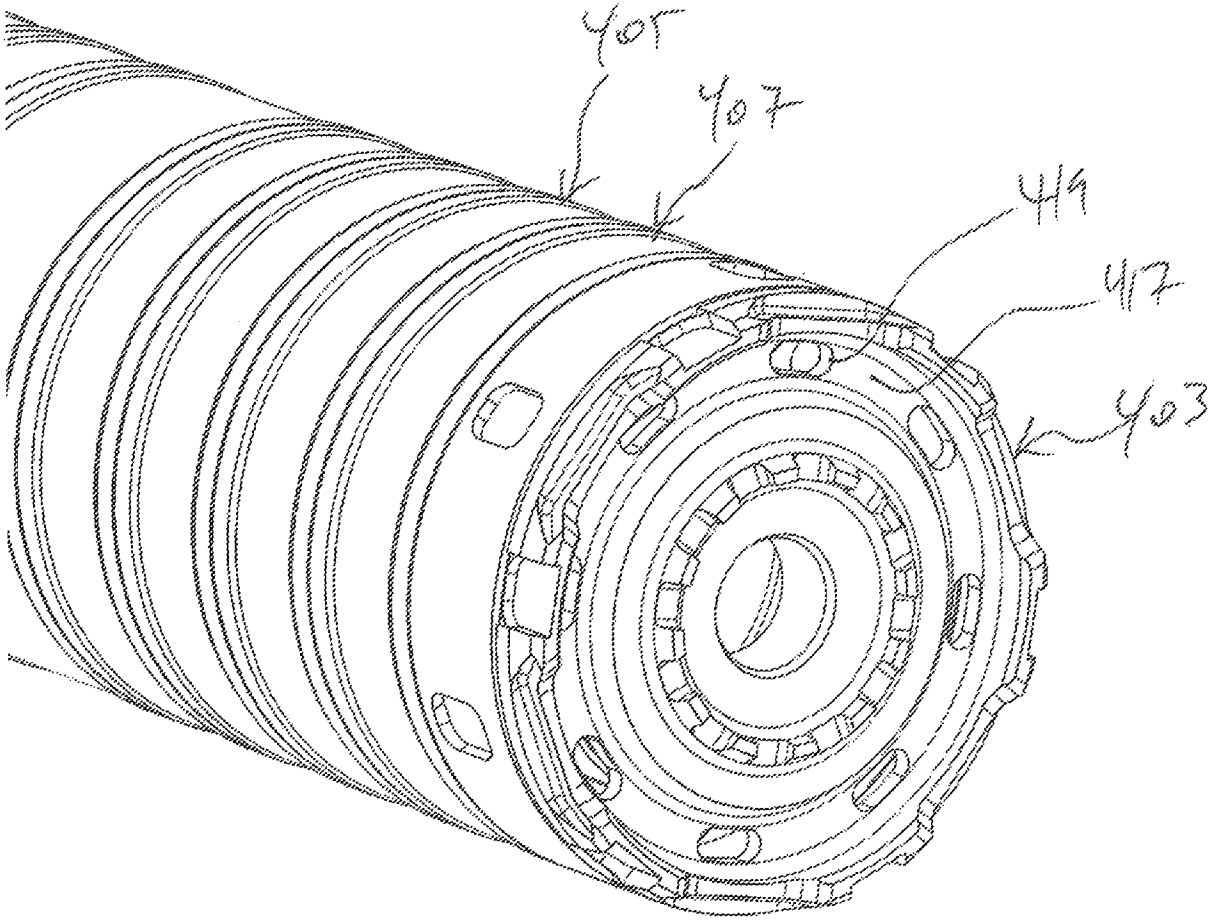
Figure 19:
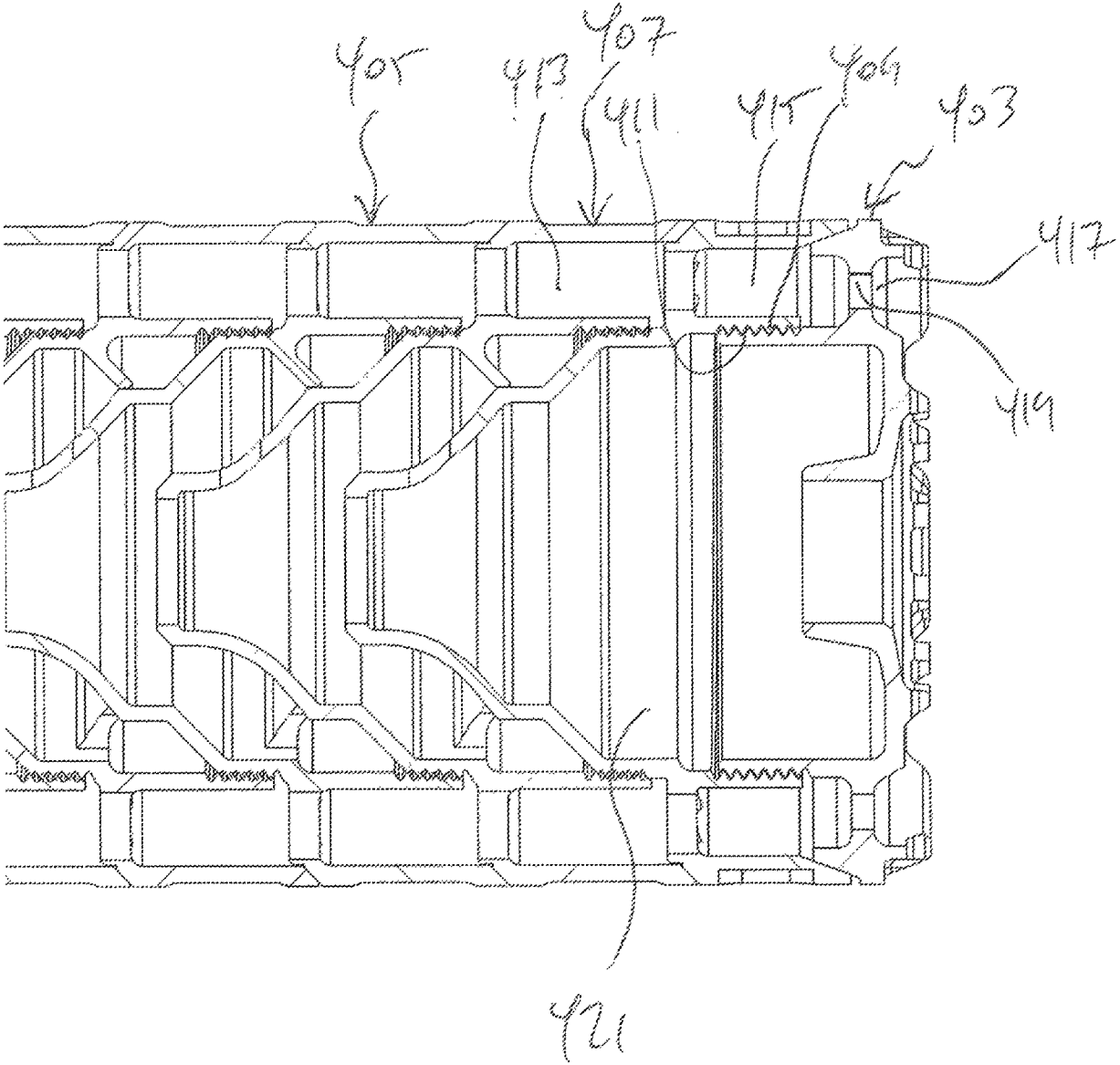

Referring to FIGS. 47 through 51D, suppressor 801 comprises a front cap 803 configured to be coupled to the forward end of body 805 or a baffle stack, such as stack 405 of FIG. 26, for use in adjusting the function of suppressor 801. As shown, body 805 is a unitary object formed by additive manufacturing, though separate components may be permanently joined together, such as by welding. Front cap 803 comprises a cap 807 and a cover 809 threadingly coupled to cap 807 and rotatable relative to cap 807. Cap 807 comprises threads 811 configured for engaging threads 813 of the forward end of body 805. As with suppressors described above, suppressor 801 has an outer coaxial chamber 815 that extends to the front end of body 805 and terminates in a plurality of ports 817. Cap ports 819 are formed in cap 807 between outer wall 821 and central portion 823 of cap 807, cap ports 819 being in fluid communication with coaxial chamber 815 through ports 817.

Cover 809 comprises threads 825 configured for engaging threads 827 of the forward end of cap 807, and rotation of cover 809 relative to cap 807 causes longitudinal translation of cover 809 relative to cap 807. A conical front surface 831 of central portion 823 and a conical rear surface 833 of cover 809 are configured to sealingly mate when cover is moved rearward to a closed position, as shown in FIGS. 47, 48, and 51A. As shown in FIGS. 51B through 51D, as cover 809 is rotated to cause forward translation to a partially or fully open position, a gap 835 is formed between surfaces 831, 833, and rotation of cover 809 is used to selectively control the amount of gases passing from cap ports 819 through gap 835 and out of bore 829.

Referring to FIGS. 52 through 54C, suppressor 901 comprises a front cap 903 configured to be coupled to the forward end of body 805, as shown and described above, or a baffle stack, such as stack 405 of FIG. 26, for use in adjusting the function of suppressor 901. Front cap 903 comprises a cap 905 and an external adjustment ring 907 threadingly coupled to cap 905 and rotatable relative to cap 905. Cap 905 comprises threads 909 configured for engaging threads 813 of the forward end of body 805. At least one cap port 911 (two shown in the figure) are formed in cap 905 between an inner wall 913 and an outer wall 915, cap ports 911 being in fluid communication with coaxial chamber 815 through ports 817. Outer wall 915 terminates rearward of the forward end of each port 911, forming a passage for gases to escape each port 911.

Adjustment ring 907 is used to prevent or adjust the amount of gases passing through ports 911. Ring 907 is generally formed as a cylinder and comprises threads 917 configured for engaging threads 919 of the forward end of cap 905, rotation of ring 907 relative to cap 905 causing longitudinal translation of ring 907 relative to cap 905. As most easily visible in FIG. 53, ring 907 is shown with rear wall portion 921 having an optional curved reliefs 923 formed therein for each cap port 911.

Figure 54B:
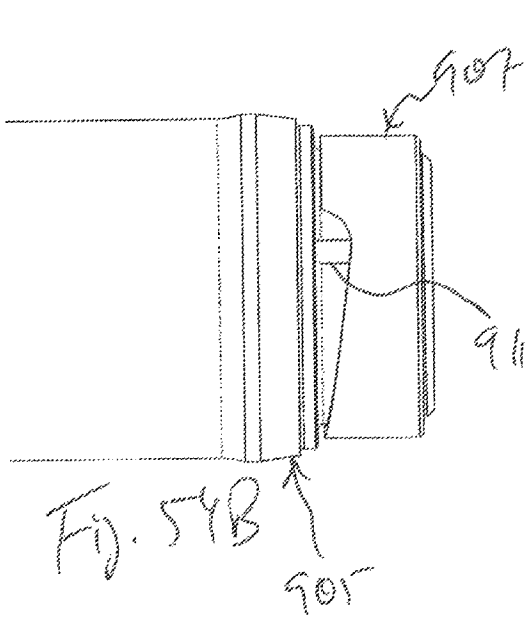
Figure 54C:
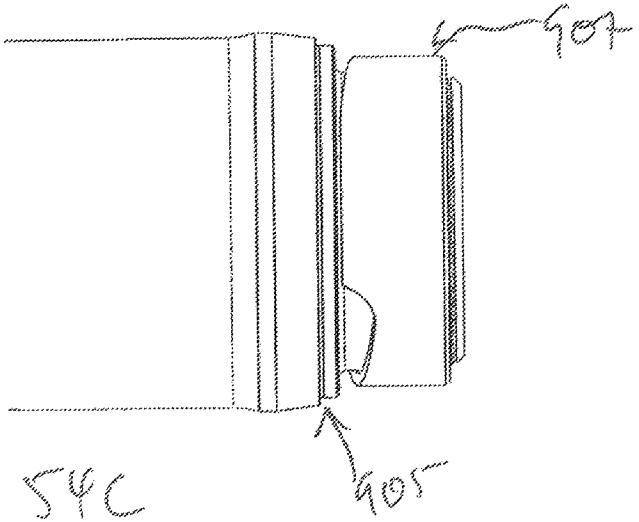
Figure 54A:
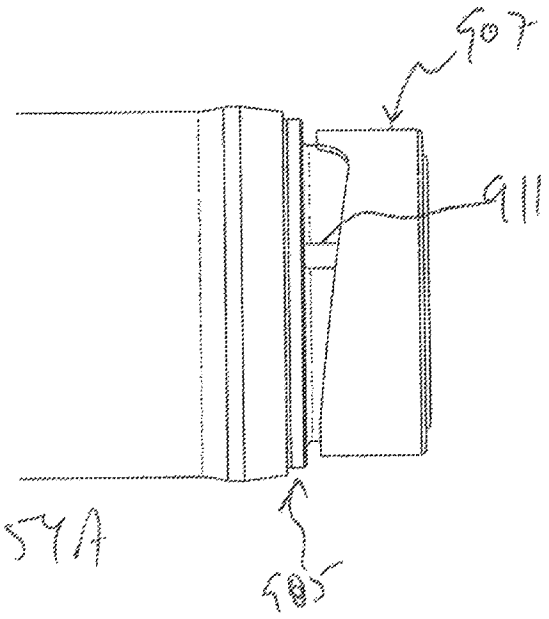

To allow for the flow of gases through cap ports 911 and out of cap 905, ring 907 is rotated to move rear wall portion 921 of ring 907 to a partially or fully open position, as shown in FIGS. 52, 54A, and 54B. Curved reliefs 923 allow for ports 911 to be opened with less rotation of ring 907 than if reliefs are not present, though other embodiments do not include reliefs 923 and rely solely on translation caused by the thread pitch. To prevent the flow of gases through cap ports 911 and out of cap 905, ring 907 is rotated to move rear wall portion 921 of ring 907 to a closed position, as shown in FIG. 54C.

Figure 55:
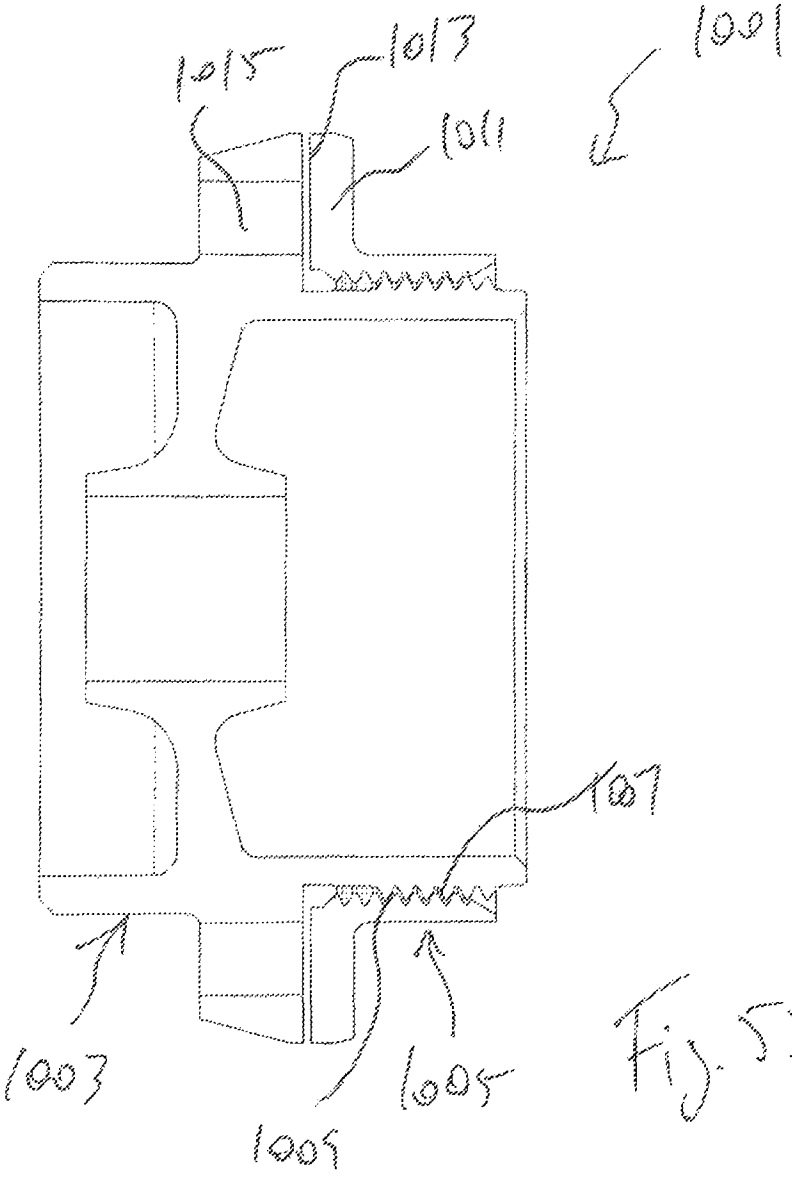

FIG. 55 illustrates another alternative embodiment of an adjustable front cap for a suppressor. Front cap 1001 is configured to be coupled to the forward end of body 805, as shown and described above, or a baffle stack, such as stack 405 of FIG. 26. Front cap 1001 comprises a cap 1003 and an external adjustment ring 1005, ring 1005 having threads 1007 for engaging threads 1009 of cap 1003. Ring 1005 has a toroidal wall 1011 configured to sealingly mate with a forward surface 1013 of cap 1003 for preventing gases from flowing through cap port 1015 (which is in fluid communication with a coaxial chamber, as shown and described above) and out of cap 1003 when ring 1005 is in the closed position, as shown. When ring 1005 is rotated to cause forward translation of ring 1005, a gap is formed between wall 1011 and surface 1013, allowing gases to flow through cap port 1015 and out of cap 1003.

For all embodiments disclosed herein, mating surfaces are shown as either 90-degree shoulders or as tapers, but other embodiments may use either type of mating surface. In addition, embodiments with rotatable components may include detents, friction devices, or similar items for preventing undesired rotation of the components.

At least one embodiment is disclosed, and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. An assembly for directing gas to an action of a firearm, the assembly comprising:

a barrel having a barrel bore and a circumferential first forward-facing sealing surface on a forward portion of the barrel;

a gas block having a block bore and a block port for directing gases from the block bore through the block port, the gas block having a circumferential first rearward-facing sealing surface rearward of the block port and configured to sealingly mate with the first forward-facing sealing surface, the gas block also having a circumferential second forward-facing sealing surface forward of the block port; and a component having a component bore and attached to a forward end of the barrel, the component bore being in fluid communication with the barrel bore, at least one component port communicating the component bore with the block port, the component having a circumferential second rearward-facing sealing surface configured to sealingly mate with the second forward-facing sealing surface, a portion of the component rearward of the rearward-facing sealing surface being received within the bore of the gas block;

wherein the barrel and component cooperate to sealingly retain the gas block therebetween.

2. The assembly of claim 1, further comprising:

a circumferential external groove formed on the component and communicating the at least one component port with the block port.

3. The assembly of claim 1, wherein the at least one component port is angled relative to the component bore.

4. The assembly of claim 1, wherein the component is an extension extending forward from the forward portion of the barrel.

5. The assembly of claim 1, wherein a forward portion of the component comprises a flash hider.

6. The assembly of claim 1, wherein a forward portion of the component comprises a muzzle brake.

7. The assembly of claim 1, wherein a forward portion of the component comprises a rear portion of a suppressor.

8. The assembly of claim 1, further comprising:

external barrel threads formed on the forward portion of the barrel; and internal component threads formed in a rear portion of the component;

wherein the component is threadingly attached to the barrel.

9. The assembly of claim 1, further comprising:

external barrel threads formed on the forward portion of the barrel;

internal component threads formed in a rear portion of the component; and external component threads formed on a forward portion of the component and having a diameter and a pitch substantially identical to the external barrel threads;

wherein the component is threadingly attached to the barrel; and wherein an item configured to be threadingly attached to the barrel can be threadingly attached to the forward portion of the component.

10. The assembly of claim 1, wherein at least one of the sealing surfaces is a tapered surface.

11. The assembly of claim 1, wherein at least one of the sealing surfaces is a shoulder.

12. An assembly for directing gas to an action of a firearm, the assembly comprising:

a barrel having a barrel bore and a circumferential first forward-facing sealing surface on a forward portion of the barrel;

a gas block having a block bore and a block port for directing gases from the block bore through the block port, the gas block having a circumferential first rearward-facing sealing surface rearward of the block port and configured to sealingly mate with the first forward-facing sealing surface, the gas block also having a circumferential second forward-facing sealing surface forward of the block port;

a component having a component bore and attached to a forward end of the barrel, the component bore being in fluid communication with the barrel bore, at least one component port communicating the component bore with the block port, the component having a circumferential second rearward-facing sealing surface configured to sealingly mate with the second forward-facing sealing surface, a portion of the component rearward of the rearward-facing sealing surface being received within the bore of the gas block; and a circumferential external groove formed on the component and communicating the at least one component port with the block port;

wherein the barrel and component cooperate to sealingly retain the gas block therebetween.

13. The assembly of claim 12, wherein the at least one component port is angled relative to the component bore.

14. The assembly of claim 12, further comprising:

external barrel threads formed on the forward portion of the barrel; and internal component threads formed in a rear portion of the component;

wherein the component is threadingly attached to the barrel.

15. An assembly for directing gas to an action of a firearm, the assembly comprising:

a barrel having a barrel bore and a circumferential first forward-facing sealing surface on a forward portion of the barrel;

a gas block having a block bore and a block port for directing gases from the block bore through the block port, the gas block having a circumferential first rearward-facing sealing surface rearward of the block port and configured to sealingly mate with the first forward-facing sealing surface, the gas block also having a circumferential second forward-facing sealing surface forward of the block port;

a component having a component bore and attached to a forward end of the barrel, the component bore being in fluid communication with the barrel bore, at least one component port communicating the component bore with the block port, the component having a circumferential second rearward-facing sealing surface configured to sealingly mate with the second forward-facing sealing surface, a portion of the component rearward of the rearward-facing sealing surface being received within the bore of the gas block;

external barrel threads formed on the forward portion of the barrel; and internal component threads formed in a rear portion of the component;

wherein the component is threadingly attached to the barrel; and wherein the barrel and component cooperate to sealingly retain the gas block therebetween.

16. The assembly of claim 15, wherein the component is an extension extending forward from the forward portion of the barrel.

17. The assembly of claim 15, wherein a forward portion of the component comprises a flash hider.

18. The assembly of claim 15, wherein a forward portion of the component comprises a muzzle brake.

19. The assembly of claim 15, wherein a forward portion of the component comprises a rear portion of a suppressor.

20. The assembly of claim 15, further comprising:

external component threads formed on a forward portion of the component and having a diameter and a pitch substantially identical to the external barrel threads;

wherein an item configured to be threadingly attached to the barrel can be threadingly attached to the forward portion of the component.

* * * * *